US005265920A

United States Patent [19]

Kaup et al.

[11] Patent Number: 5,265,920

[45] Date of Patent: Nov. 30, 1993

[54] DRIVE ROD LOCK

[75] Inventors: Ludger Kaup, Everswinkel; Renate Berning, Ostbevern, both of Fed. Rep. of Germany

[73] Assignee: Aug. Winkaus GmbH & Co. KG, Telgte, Fed. Rep. of Germany

[21] Appl. No.: 706,299

[22] Filed: May 28, 1991

Related U.S. Application Data

[63] Continuation-in-part of Ser. No. 529,914, May 29, 1990, abandoned, which is a continuation-in-part of Ser. No. 405,344, Sep. 11, 1989, abandoned.

[30] Foreign Application Priority Data

Sep. 16, 1988 [DE] Fed. Rep. of Germany ..... 3831529
Apr. 29, 1991 [DE] Fed. Rep. of Germany ..... 4114007

[51] Int. Cl.[5] ..... E05B 59/00; E05C 1/06

[52] U.S. Cl. ..... 292/40; 292/51; 70/107; 70/110

[58] Field of Search ..... 292/39, 40, 51, 346; 70/107, 108, 110, 111

[56] References Cited

U.S. PATENT DOCUMENTS 2,721,092 10/1955 Simmons .
4,840,050 6/1989 Gotanda .
4,962,653 10/1990 Kaup .
5,027,625 7/1991 Krachten ..... 70/107

FOREIGN PATENT DOCUMENTS 195288 1/1958 Austria .
0168001 1/1986 European Pat. Off. .
0182751 5/1986 European Pat. Off. .
401660 9/1924 Fed. Rep. of Germany .
690168 3/1940 Fed. Rep. of Germany .
1060285 6/1959 Fed. Rep. of Germany .
1247171 10/1967 Fed. Rep. of Germany .
1292034 4/1969 Fed. Rep. of Germany .
1553370 6/1969 Fed. Rep. of Germany .
1907061 9/1969 Fed. Rep. of Germany .
2010068 9/1971 Fed. Rep. of Germany .
7934422 4/1980 Fed. Rep. of Germany .
8808757 10/1980 Fed. Rep. of Germany .
3139574 4/1983 Fed. Rep. of Germany .
8210306 1/1986 Fed. Rep. of Germany .
3603962 8/1986 Fed. Rep. of Germany .
3605826 8/1987 Fed. Rep. of Germany .
3801441 9/1988 Fed. Rep. of Germany .
3823132 4/1990 Fed. Rep. of Germany .
449928 3/1913 France .
1261221 4/1961 France .
1346283 11/1963 France .
2427450 12/1979 France .
2451441 10/1980 France .
174580 4/1935 Switzerland .
294220 1/1954 Switzerland .
197475 12/1922 United Kingdom .
631538 9/1948 United Kingdom .
2095788 10/1982 United Kingdom .
2150269 7/1985 United Kingdom .

*Primary Examiner*—Peter M. Cuomo
*Assistant Examiner*—Suzanne L. Dino
*Attorney, Agent, or Firm*—Anderson Kill Olick & Oshinsky

[57] ABSTRACT

In the case of a drive rod lock, the drive is guided in the region of the faceplate and in that a housing is mounted on the faceplate. Rotatably mounted in the housing is a handle bush and follower for moving the drive rod. This handle bush and follower assembly is pretensioned into a mid-way position and can be pivoted out of this mid-way position in opposite directions of rotation. The handle bush and follower assembly acts on a control element which is guided parallel with the drive rod and in the vicinity of a narrow side of the housing remote from the drive rod. A handle bush and follower restoring spring engages this control element. A two-armed transmission lever extends from the control element to the drive rod and is mounted in the housing between the control element and the drive rod. A clearance exists between the transmission lever and the control element.

77 Claims, 13 Drawing Sheets

DRIVE ROD LOCK

This is a continuation-in-part-application of U.S. Ser. No. 07/529,914 filed on May 29, 1990, which is again a continuation-in-part-application of U.S. Ser. No. 07/405,344 filed on Sep. 11, 1989 both abandoned.

BACKGROUND OF THE INVENTION

The invention relates to a drive rod lock for doors or windows, with a housing, a handle bush and follower rotatable by a handle or knob and mounted to rotate about an axis at right-angles to the door or window surface, a restoring spring which so pretensions the handle bush and follower into a rest position that it can be rotated in opposite directions of rotation out of the rest position, a drive rod guided lengthwise of a face plate of the housing and serving to control lock elements, and connecting the handle bush and follower to the drive rod, a transmission linkage comprising a transmission lever, said transmission linkage serving—subject to clearance—to displace the drive rod, the rotation of the handle bush and follower in a first direction of rotation causing displacement of the drive rod into a locking position while rotation of the handle bush and follower in a second direction of rotation results in displacement of the drive rod into an opening position, the clearance in the transmission linkage, after entry into the respective drive rod position and upon release of the handle or knob producing a return of the handle bush and follower via the restoring spring into its rest position, leaving the drive rod in whichever drive rod position has been reached.

STATEMENT OF THE PRIOR ART

A drive rod lock of the above described type is known from European Offenlegungsschrift 168 001, in fact particularly from FIGS. 9 and 10 therein and is also known from European Patent Specification No. 182 751.

Due to the use of the transmission lever in the transmission linkage, it is possible for the drive rod at an angle of rotation of the handle bush and follower of about 45° C. to be displaced out of the open position into the locking position or vice versa, in fact in spite of the clearance which is embodied in the transmission linkage.

In European Offenlegungsschrift No. 168 001, there is disposed between the handle bush and follower and the drive rod, on the handle bush and follower side, a first two-armed transmission lever which, via a pairing of tooth segments, acts on a second transmission lever, the said second transmission lever finally acting, with a change of direction of the transmission, on the drive rod. The construction of the transmission linkage is thus relatively complicated and expensive to produce.

According to European Patent Specification No. 182 751, the handle bush and follower acts through a clearance-encumbered coupling on a thrust rod which is guided approximately vertically in the vicinity of the facing plate. This thrust rod then acts on a single-armed transmission lever which is articulated in the vicinity of the edge of the housing opposite the drive rod, its end which is towards the drive rod engaging the drive rod. Also this construction is of complicated manufacture and its production costs are high.

OBJECT OF THE INVENTION

The invention is based on the problem of constructing a drive rod lock of the type described at the outset which retains the possibility of drive rod displacement with a comparatively small angle of rotation of the handle bush and follower and in a simplified way, so that production is facilitated and costs are reduced.

SUMMARY OF THE INVENTION

A drive rod lock for doors or windows comprises a housing, a handle bush and follower rotatable by a handle or knob and mounted to rotate about an axis at right-angles to the door or window surface. A restoring spring pretensions the handle bush and follower into a rest position so that it can be rotated in opposite directions of rotation out of the rest position. A drive rod is guided lengthwise of a face plate on the housing and serves to control lock elements. For connecting the handle bush and follower with the drive rod, a transmission linkage comprises a transmission lever. Said transmission linkage serves—subject to clearance—to displace the drive rod. Rotation of the handle bush and follower in a first direction of rotation causes displacement of the drive rod into a locking position, and rotation of the handle bush and follower in a second direction of rotation causes displacement of the drive rod into an opening position. The clearance in the transmission linkage after entry into the relevant drive rod position and upon release of the handle or knob admits a return of the handle bush and follower via the restoring spring into its rest position while leaving the drive rod in whichever drive rod position has been reached. The transmission linkage comprises a control element guided in the vicinity of a limiting edge of the housing disposed opposite the face plate parallel with the drive rod. The control element is coupled substantially without clearance to the handle bush and follower. The restoring spring engages the control element. The transmission lever is constructed as a two-armed transmission lever which is rockably mounted at a location between the drive rod and the control element on the housing. A first shorter lever arm is, with clearance, in engagement with the control element, a longer lever arm engages the drive rod.

In the case of the development according to the invention, a particular advantage is that a single element, namely the linearly movable control element, can be used both for engagement of the restoring spring and also for transmitting movement from the handle bush and follower to the drive rod. Besides this control element there is required within the transmission linkage only said two-armed transmission lever. By locating the control element in the vicinity of the housing edge remote from the face plate, the space available within the housing is used in the very best way. The overall space requirement is reduced. This has the advantage that the width of the lock housing which corresponds to the depth of insertion into the door or window frame, can be kept small so that the width of the door or windowspar on the lock side can as desired be likewise kept to the minimum.

The embodiment according to the invention is particularly applicable to those door locks in which the drive rod is moved exclusively by the handle bush and follower, in other words not by the lock cylinder which can in any case be provided in order to arrest the drive rod in its locking position.

As is per se already known from the two above citations in respect of the state of the art, it is also possible with the embodiment according to the invention that the handle bush and follower can act on a latching bolt which is pretensioned in the direction of an advanced position by a latch bolt spring.

The drive rod may have distributed over its length a plurality of locking elements so that the window and in particular a door can be locked over its entire height within the associated frame part. Additionally, a convention bolt may be provided which is guided for displacement at right-angles to the faceplate in the housing and which is movable and drivingly connected to the drive rod to be displaced between an advanced position corresponding to the locked position of the drive rod and a retracted position corresponding to the open position of the drive rod.

In order to lock the bolt in its advanced position by the drive rod—when this is in its locking position—and in order to be able to secure it against unauthorised retraction, it is furthermore proposed that there be between the drive rod and the bolt a transmission gearing which is subject to backlash, so that upon displacement of the drive rod in the direction of its locking position, the bolt driven by the drive rod reaches its advanced position before the drive rod reaches its locking position. The drive rod and the bolt comprise bolt-securing elements which, after entry of the bolt into its advanced position and in the subsequent residual movement of the drive rod in the direction of its locking position come into engagement and prevent the return of the bolt to its retracted position.

The drive rod lock can in conventional manner be arrested by a closure cylinder, for example so that the closure cylinder has a bit which acts on an auxiliary bolt. This auxiliary bolt is displaceable transversely to the longitudinal direction of the drive rod between a drive rod released position and a drive rod locked position and which, in the drive rod locked position, engages a drive rod locking member which is fixed on the drive rod.

In order to be able to lock the auxiliary bolt in its drive rod locked position, it is suggested that the bit of the locking cylinder with phase displacement as compared with its effect on the auxiliary bolt further acts on a spring-loaded latch for the auxiliary bolt, which in the position of key withdrawal from the lock cylinder locks the movement of the auxiliary bolt at least then, when the auxiliary bolt assumes the drive rod locked position.

A particularly compact construction of the assembly which consists of the control element and the restoring spring arrangement can be achieved if the restoring spring consists of a coil thrust spring which, in a rest position of the control element which corresponds to a rest position of the handle bush and follower, has both ends bearing on a stud of the housing and on an abutment on the control element.

The coupling between the handle bush and follower and the control element can be established in that the control element comprises a driver stud which engages a radially elongated marginal cut-out in the handle bush and follower.

At a small angle of rotation of the handle bush and follower, in order to achieve the greatest possible path of displacement of the control element, in fact for both directions of rotation of the handle bush and follower, it is suggested that in the rest position of the handle bush and follower, the line connecting the axis of rotation of the handle bush and follower to the axis of the driver stud should be approximately at right-angles to the direction of displacement of the control element.

In order to be able to offer the consumer a product which behaves similarly to what are for him standard doors with insertable key type locks which are handle operated, it is suggested that in order to bring about the locking position or open position of the drive rod, the handle bush and follower should be in each case rotatable through about 45° out of the rest position. The consumer then encounters the following situation: to open the door, he only needs to depress the handle in the usual way through about 45°. Then the drive rod lock opens when the drive rod is in the locking position. On the other hand, if the door is to be locked, then the handle only needs to be pivoted upwardly through 45° and the drive rod will move into its locking position. In this respect, the handle bush and follower can be so disposed that in the rest position the handle assumes the horizontal position normally found with doors.

According to a further aspect of the invention, a lock assembly for doors or windows comprises a housing, a handle bush and follower rotatable by a handle or knob and mounted to rotate about an axis at right-angles to the door or window surface. A restoring spring pretensions the handle bush and follower into a rest position so that it can be rotated in opposite directions of rotation out of the rest position. A drive unit is guided lengthwise of a face plate of the housing and serves to control at least one lock element. For connecting the handle bush and follower with the drive unit, a transmission linkage comprises a transmission lever. This transmission linkage serves—subject to clearance—to displace the drive unit. Rotation of the handle bush and follower in a first direction of rotation causes displacement of the drive unit into a locking position and rotation of the handle bush and follower in a second direction of rotation causes displacement of the drive unit into an opening position. The clearance in the transmission linkage after entry into the relevant drive unit position and upon release of the handle or knob admits a return of the handle bush and follower via the restoring spring into its rest position while leaving the drive unit in whichever drive rod position has been reached. The lock assembly further comprises accommodating means for accommodating a locking unit, which is rotatable between a drive unit releasing angular position and a drive unit locking angular position.

The locking unit may comprise a hub member. Said hub member may comprise coupling means for being coupled to a hand-operated switch member. Said coupling means may comprise a non-circular recess extending through said hub member along the axis of rotation thereof and may be adapted to receive a coupling spike.

The hub member may also have coupling means for being coupled to a cylinder lock to be fixed with respect to one of said housing and said door or window. Said coupling means may again comprise a non-circular recess extending through said hub member along the axis of rotation thereof.

More particularly, said hub member may be coupled for common rotation to both a hand-operated switch member provided adjacent a first side face of said housing and a key-operated lock cylinder provided adjacent a second side face of said housing.

In this case, according to a preferred embodiment, the key operated lock cylinder has a rotor member with a key receiving slot. The key is withdrawable from said slot only in a zero angular position of said rotor member with respect to said lock cylinder. The rotor member is coupled to said hub member by coupling means permitting angular play between said rotor member and said hub member. The angular play corresponds at least to the angular distance between said drive unit locking position and said drive unit releasing position of said hub member.

For example, the lock cylinder is provided with a coupling spike extending through a coupling recess of the hub member, and said hand-operated switch member is fixable on an end portion of said coupling spike.

Again, the transmission linkage may comprise a control element guided in the vicinity of a limiting edge of the housing disposed opposite the face plate parallel with the guiding direction of the drive unit. The control element may be coupled substantially without clearance to the handle bush and follower, while said restoring spring may engage said control element. Said transmission lever may be constructed as a two-armed transmission lever which is rockably mounted at a location between the face plate and the control element on the housing. A first shorter lever arm may be, with clearance, in engagement with the control element, and a longer lever arm may engage the drive rod.

The drive unit may have at least one control profile extending substantially parallel to said face plate. This control profile may cooperate with a hub member engaging said control profile. Said hub member may be rotatably mounted in said housing between a drive unit releasing angular position and a drive unit locking angular position. Said control profile and said hub member may be shaped such that at least one of the below-mentioned requirements is fulfilled:

a) only in said locking position of said drive unit, said hub member is rotatable between its drive unit releasing angular position and its drive unit locking angular position;
b) movement of said drive unit from its locking position towards its opening position is only possible, when said hub member is in said drive unit releasing angular position and
c) in positions of said drive unit remote from said locking position, a rotation of said hub member from said drive unit releasing angular position towards said drive unit locking angular position is prevented.

The drive unit may cooperate with a closing sensor unit responsive to opening and closing said door or windown. This closing sensor unit permits movement of said drive unit from said opening position to said locking position, only when the respective window or door is closed.

BRIEF DESCRIPTION OF THE DRAWINGS

The invention is explained in greater detail hereinafter with reference to an example of embodiment shown in the accompanying drawings, in which.

DESCRIPTION OF PREFERRED EMBODIMENTS

Figure 1:
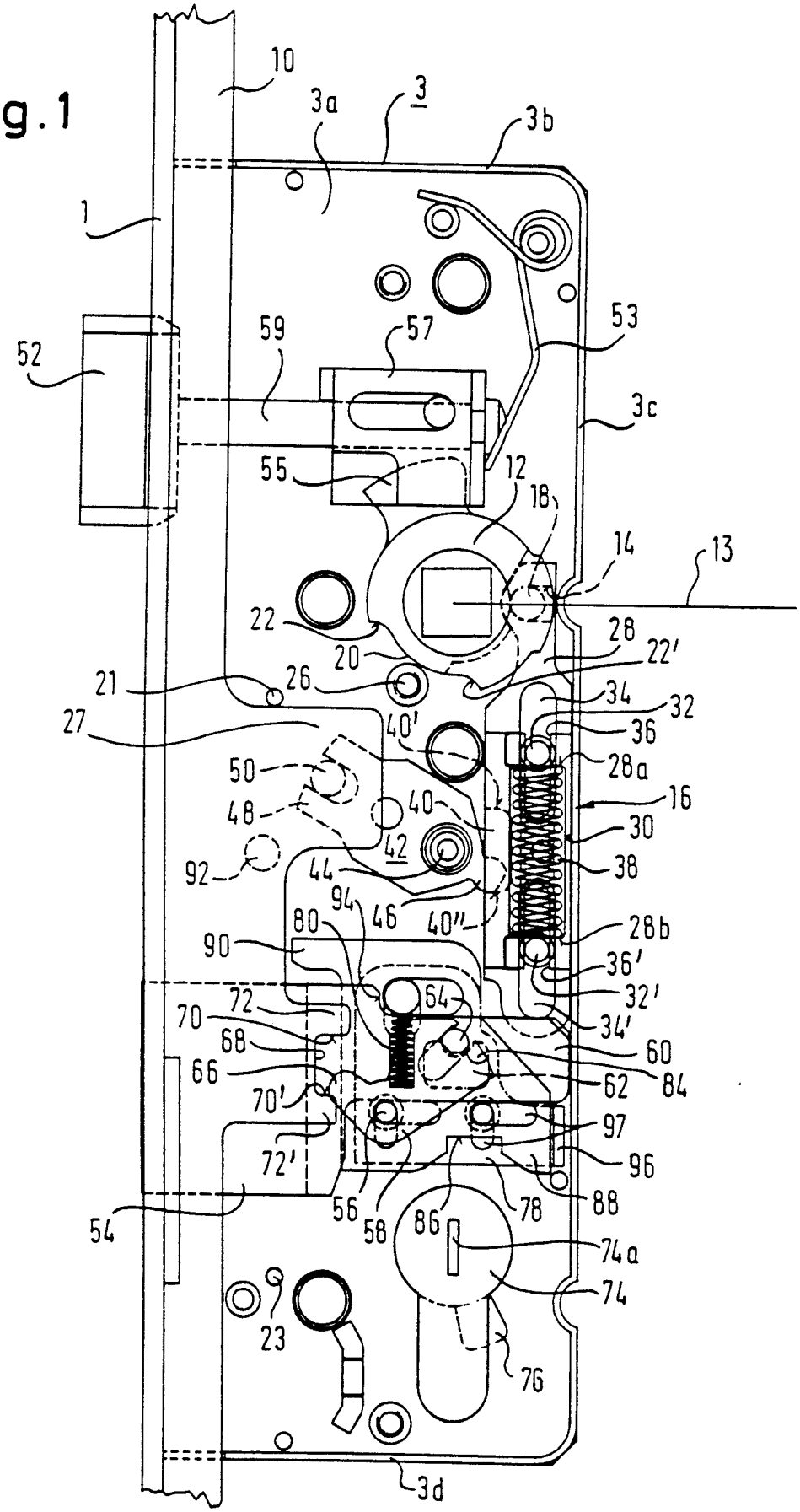
FIG. 1 shows a drive rod lock according to the invention with the drive rod in the opening position and the handle bush and follower in the rest position.

In FIG. 1, a lock housing 3 is mounted on a faceplate 1. This lock housing 3 consists of a bottom plate 3*a* and of narrow side walls 3*b*, 3*c*, 3*d* and a lock cover not shown in the drawings. Guided on the faceplate 1 is a drive rod 10 which as a rule extends over the total height of the window or door on its side which is remote from the vertical pivoting axis. Mounted on the drive rod 10 are locking elements such as are shown for example in FIGS. 4 to 8 which are to be described later on. These closure elements are intended for engagement with corresponding counter-locking elements on the door or window frame. Furthermore, the drive rod lock comprises a conventional latch 52 which, when the door is closed, is pushed back against the force of a spring 53 and, for opening of the door, can be retracted by a handle bush and follower 12 with the assistance of a cam 55 of the handle bush and follower 12, and of an entraining plate 57 and of a latch tail 59.

Figure 2:
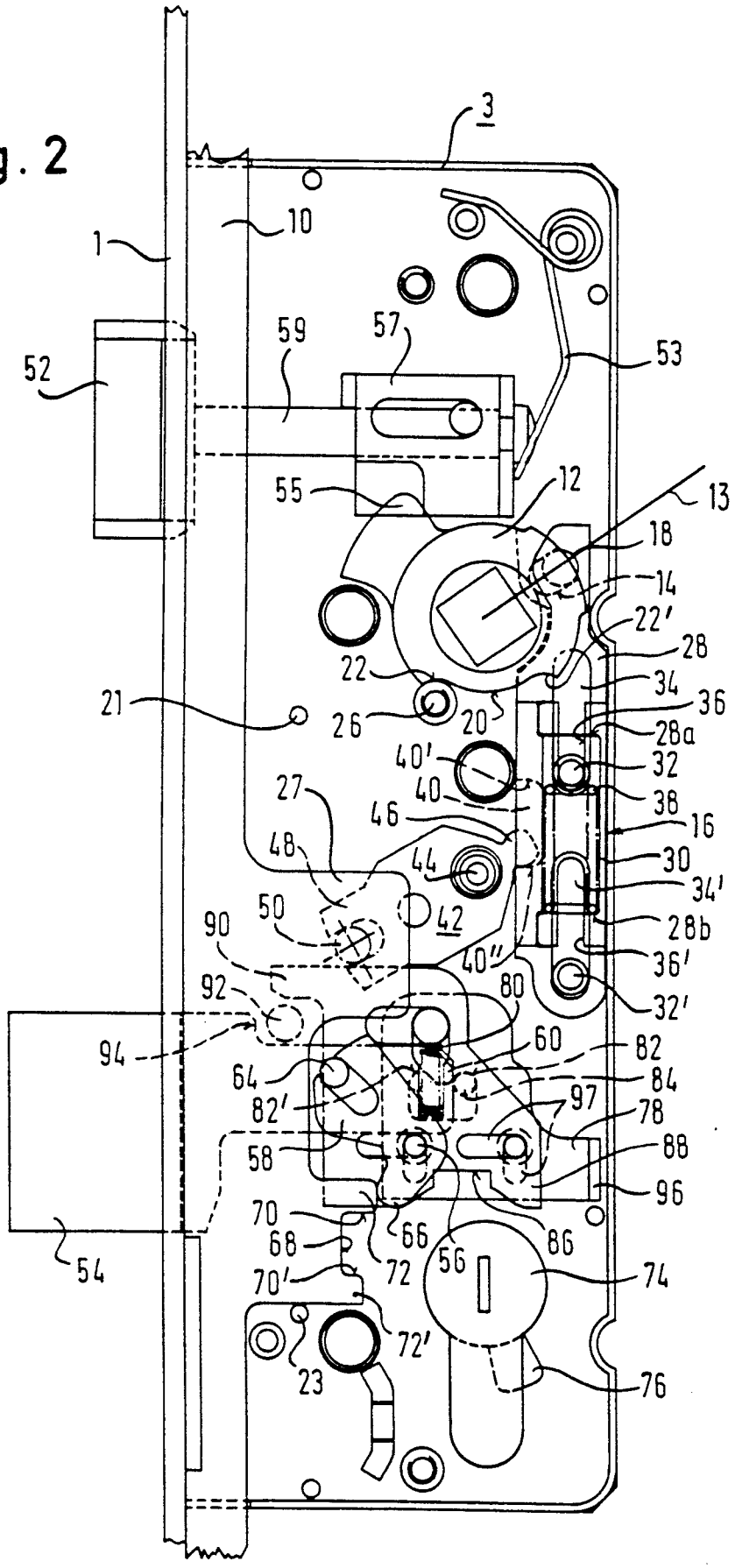
FIG. 2 shows the drive rod lock according to FIG. 1 after rotation of the handle bush and follower in an anticlockwise direction, displacement of the drive rod into the locking position and advancement of the bolt.

Finally, the drive rod lock comprises a bolt 54 which passes through the faceplate 1 and which is advanced into the position shown in FIG. 2, when the drive rod 10 is displaced into its locking position, i.e. downwardly.

A lock cylinder 74 with a lock bit 76 and a key insertion slot 74*a* serves to arrest the drive rod 10 in its bottom locking position and, through the drive rod 10, also to arrest the bolt 54 in its advanced position shown in FIG. 2. However, it must be established that displacement of the drive rod 10 by means of the lock cylinder 74 is not possible with this form of embodiment.

Therefore, together with the locking elements mounted on it, the drive rod 10 can only be displaced from the opening position into the closing position and vice versa by the external and/or internal door handle (not shown) coupled to the handle bush and follower 12.

The handle bush and follower 12 has a marginal recess 14 engaged by the drive journal 18 mounted on a control element 16 which is adapted for displacement parallel with the movement of the drive rod. To limit the angle of rotation of the door handle, there is on the handle bush and follower 12 a further recess 20 extending in the peripheral direction and carrying limiting faces 22, 22' which in the extreme positions of the door handle pivoting range, rest on an abutment journal 26 connecting the lock cover (not shown) and the lock bottom 3*a*.

The control element 16 preferably consists of a carrier plate 28 displaceably guided on the lock bottom 3*a* and a spring mounting frame 30 rigidly disposed on the carrier plate 28. Carrier plate 28 and spring mounting frame 30 can also be produced in one piece by a casting process. For guiding the control element 16, there are between the lock bottom 3*a* and the lock cover, not shown, two spaced-apart studs 32, 32'. The carrier plate 28 has, one behind the other, two longitudinal slots 34, 34' which extend substantially in the longitudinal central plane of the carrier plate 28, the mean spacing between them corresponding to the gap between the studs 32, 32'. The spring mounting frame 30 is provided on the narrow side areas with a connecting link guide 36, 36' in which the studs 32, 32' engage in the horizontal neutral position of the handle. The remaining narrow side faces form together with the inner longitudinal faces of the frame the spring mounting frame 30, the height of the frame regarded at right-angles to the plane of the drawing, corresponding essentially to the outside diameter of the coil thrust spring 38.

The length of the slots 34, 34' is composed of the sine of the arc located between the extreme positions of the angle of rotation of the drive journal 18 and the diameter of the stud 32 or 32', a small amount of idle travel also having to be taken into account so that no coercion is created between the relevant extreme position of the handle bush and follower 12 and the simultaneous extreme position of the control element 60.

What is essential is that in the rest position of the handle bush and follower 12, the coil thrust spring 38 has both its ends bearing on the appropriate stud 32, 32' as well as on bearing faces 28*a*, 28*b* of the carrier plate or spring mounting frame 30 so that upon a displacement of the carrier plate 28 downwardly, the coil thrust spring 38 remains supported on the bottom stud 32' and is compressed by the abutment 28*a* while being lifted off the upper stud 32, and vice versa.

On that side of the control element 16 which is towards the inside of the lock, there is a marginal recess 40 for engagement of a short lever arm of a transmission lever 42 which is pivotally mounted on an arbor 44 rigid with the housing. One end 46 of the transmission lever of this short lever arm is of approximately circular construction, while the other arm 48 forms a fork which engages around a stud 50 rigid with the drive rod.

In FIG. 1, the drive rod 10 is in its topmost position, the opening position. When the handle bush and follower according to FIG. 2 is pivoted anti-clockwise through 45°, the control element 16, since the clearance between the circular end 46 and the bottom end 40'' of the recess 40 is used up, entrains the end 46 upwardly with it, so that the drive rod 10 is at the same time moved downwardly in the direction of its locking position. The result is the situation shown in FIG. 2. If in this situation, then, the handle is released and the handle bush and follower 12 returns to the position shown in FIG. 1 under the action of the coil thrust spring 38, then the circular end 46 bears without clearance on the upper end face 40' of the recess 40 and a subsequent downwards displacement of the control element 16 then leads directly to a downwards movement of the circular end 46 and thus to an upwards movement of the drive rod 10 in the direction of its opening position.

For ejection of the bolt 54 there is on a bolt 56 rigid with the housing a pivotally mounted angle lever 58 which is located above the tail 60 of the bolt. It has a bifurcated arm 62 which engages around a stud 64 on the bolt tail 60. The other arm 66 of the angle lever 58 co-operates with a control profile on the drive rod 10. This control profile comprises a profile cut-out 68 and cams 72, 72' with mutually facing profile faces 70, 70'. When the drive rod 10 moves downwards, its recess 68 first moves freely relative to the arm 66 of the angle lever 58 until the profile face 70 comes to bear on the arm 66. Only then does forwards movement of the bolt 54 commence, the arm 66 finally striking the plateau of the cam 72 which extends vertically in FIG. 1. Then there is no further displacement of the bolt 54 even if the drive rod 10 continues to move farther downwards. In this way, during the remaining downwards movement of the drive rod 10, a drive rod locking bolt 92 is able to move behind a bolt shoulder 94 on the bolt 54 so that in the ejected position of the bolt 54, it is impossible to push the bolt 54 back due to the bolt 92 which is then in its lowest position.

In the position of the drive rod and bolt as shown in FIG. 2, the drive rod 10 and also the bolt 54 can be secured by actuating the lock cylinder 74. A single turn of the lock bit 76 in an anti-clockwise direction initially lifts a latch 78 against the action of a coil thrust spring 80 and a bolt 84 of an accessory bolt 88 which is captive in a latching notch 82 in the latch 78 is released, so that upon further rotation of the lock bit 76, this latter, engaging a recess 86 in the additional bolt 88, can then displace the latter leftwardly. Shifted to the left in this way, the auxiliary bolt 88 then has a dog 90 which engages behind the bolt 92 rigid with the drive rod, so that the drive rod 10 is locked against unauthorised displacement from the locking position upwardly and into the opening position.

FIG. 2 further shows how the bolt 92 which is rigid with the drive rod has moved behind the bolt shoulder 94 in order to prevent an inadmissible pushing of the bolt 54 backwards into the lock. In the extreme left hand position of the auxiliary bolt 88, the bolt 84 of the auxiliary bolt 88 is held by the tensioned latch 78, through a further retaining notch 82' so that also the auxiliary bolt 88 again assumes a locked position.

FIGS. 1 and 2 show how the auxiliary bolt 88 can only be actuated by the locking bit 76 if the drive rod 10 and the bolt 54 have first been moved into the locking positions, since an angled latching lug 96 on the latch 78 which is under the bolt tail 60, bearing on this latter, prevents the latch 78 being lifted by the lock bit 76 as long as the bolt 54 is retracted. It should further be mentioned that the latch 78 and also the auxiliary bolt 88 are guided for displacement by means of pin-and-slot guides 97.

FIG. 1 shows the drive rod lock with the drive rod 10 in the opening position. When the handle is operated in a clockwise direction, only the latch bolt 52 (FIG. 3) is retracted and the door can be opened. When this happens, the control element 16 is pushed downwardly against the action of the coil thrust spring 38 without any torque being exerted on the transmission lever 42, since a clearance (idle travel) is provided between the circular lever end 46 and the marginal recess 40. When the handle is released again, then the pretensioned control element 16 can move upwardly again and pivot the handle back into the horizontal position.

When the handle is operated (FIG. 2) in an anti-clockwise direction and is rotated through about 45°, the control element 16 is drawn upwardly and by virtue of the circular lever end 46 bearing on the bottom limiting surface 40" of the marginal recess 40, the transmission lever 42 is pivoted in an anti-clockwise direction about the bolt 44 out of the position shown in FIG. 1 into the position shown in FIG. 2. By reason of the stud-and-slot connection 48, 50, the drive rod 10 is pushed into the locking position. If, now, the handle is released again, then the coil thrust spring 38 clamped between the studs 32, 32' causes the door handle to pivot back into the horizontal rest position, since the coil thrust spring is braced at one end on the stud 32 and at the other on the narrow lateral zones 28*b* of the spring mounting frame 30. The transmission lever 42 however remains in the pivoted position shown in FIG. 2, due to the aforementioned idle travel remaining between the control element 16 and the transmission lever 42.

When the drive rod 10 is reliably locked and the bolt 54 is locked by the auxiliary bolt 88, actuation of the handle in a downwards direction is blocked, because then the end face 40' of the recess 40 bears on the end 46 of the transmission lever 42, but the lever 42 cannot be pivoted in a clockwise direction since it is connected to the drive rod 10 via the stud-and-slot connection 48, 50, and the latter is blocked by the projection 90 of the auxiliary bolt 88. This provides an opportunity for monitoring the fact that the locking position has been assumed.

FIGS. 1 and 2 show two drive rod abutment pins 21, 23 which are mounted on the cover plate. The pin 21 limits the movement of the drive rod 10 upwardly while the pin 23 limits the downwards movement of the drive rod 10.

Figure 1A:
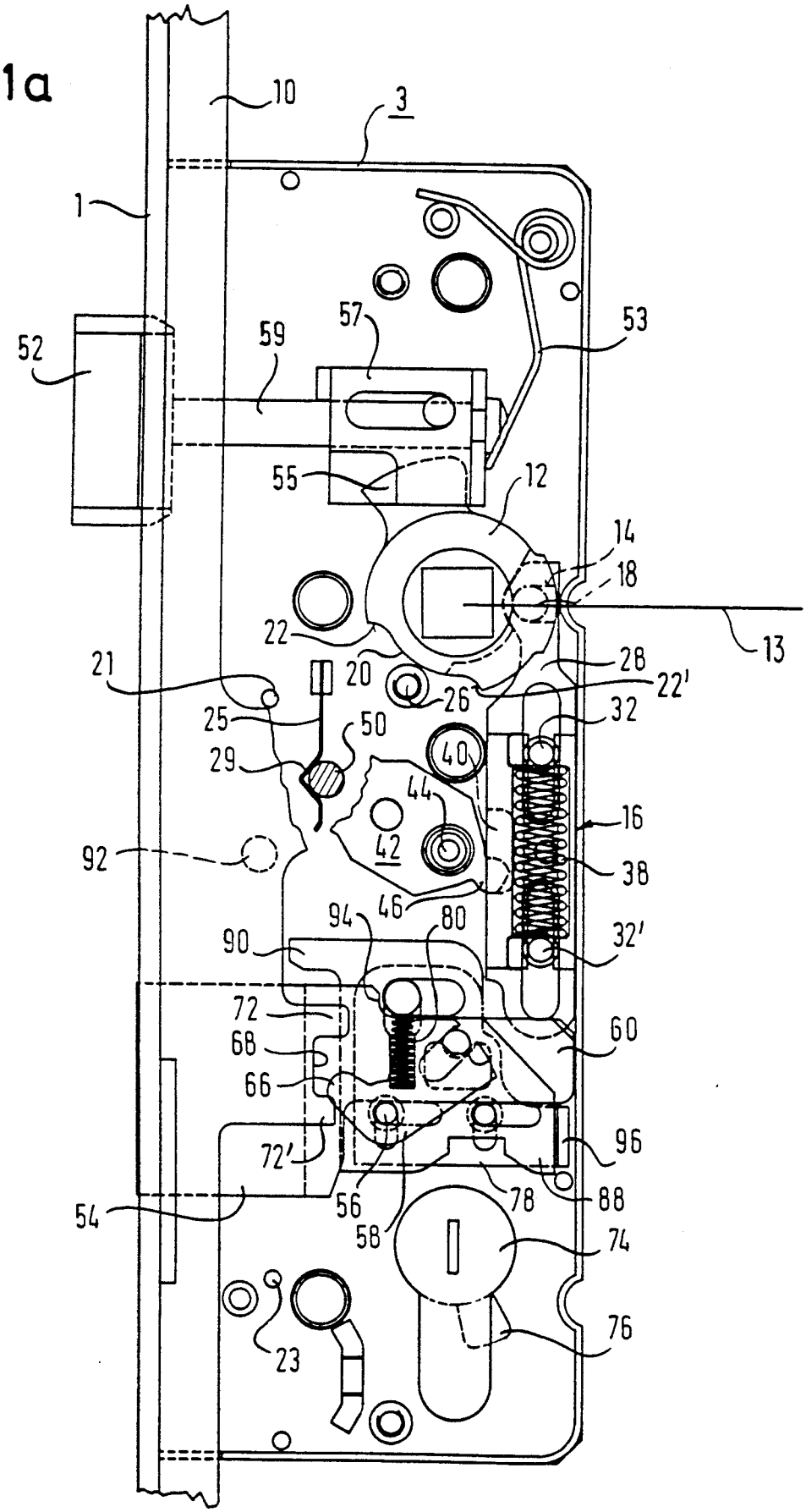
FIG. 1*a* is a view corresponding to FIG. 1, the drive rod being partially omitted in order to show a catch mechanism which secures the drive rod in the opening position, protecting it from unintentional displacement.

FIG. 1*a* shows, fixed on the lock bottom 3*a*, a catch spring 25 which is clamped at one end on the lock bottom 3*a* and is located between the drive rod portion 27 and the transmission lever 42. This catch spring 25, in the upper i.e. the opening position of the drive rod 10, has a depression 29 which bears on the periphery of the pin 50 of the stud-and-slot connection 48, 50 so that the drive rod 10 is secured in its upper or opening position to prevent unintentional displacement in the direction of the lower or locking position. This catch spring 25 can be replaced by any other kind of snap-action device.

The fitment of this catch spring 25 or other snap-action device is required because otherwise the drive rod 10 could move unintentionally downwardly out of the situation shown in FIG. 1, perhaps upon a rapid movement of a door in the direction of the locking position or during transport of the lock which has not yet been installed.

Figure 4:
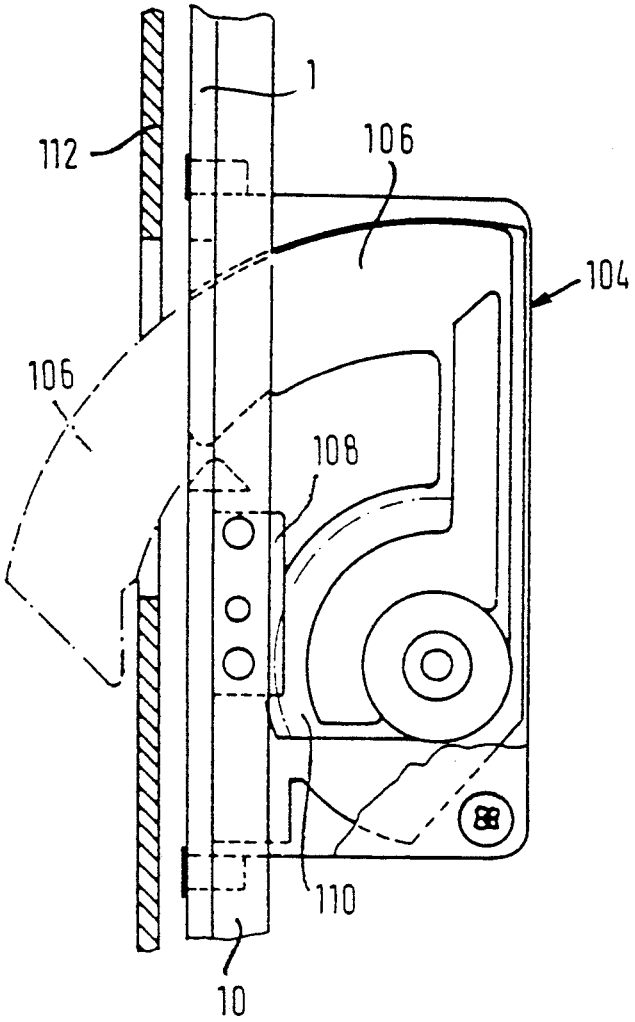
FIG. 4 shows an example of embodiment of a closure element in the form of an accessory lock.
Figure 5:
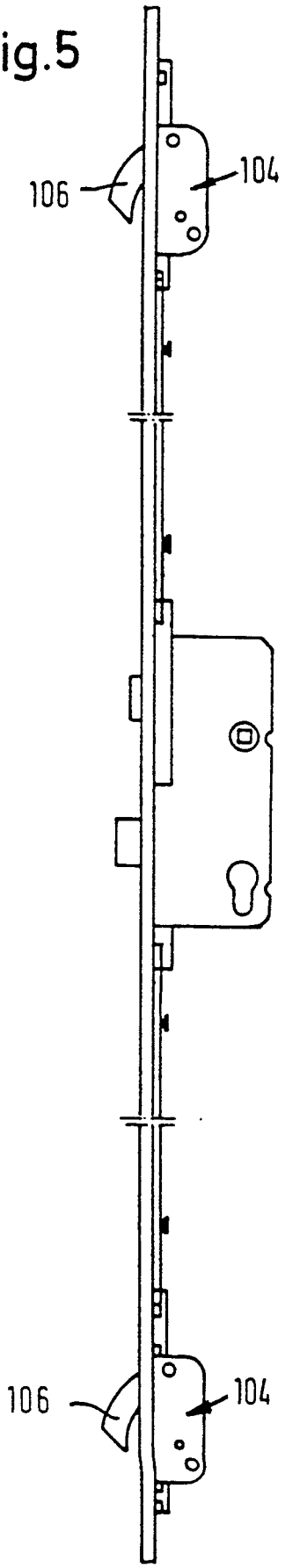
FIG. 5 shows a drive rod unit with a drive rod lock constructed according to the invention and with two additional locks according to FIG. 4.
Figure 6:
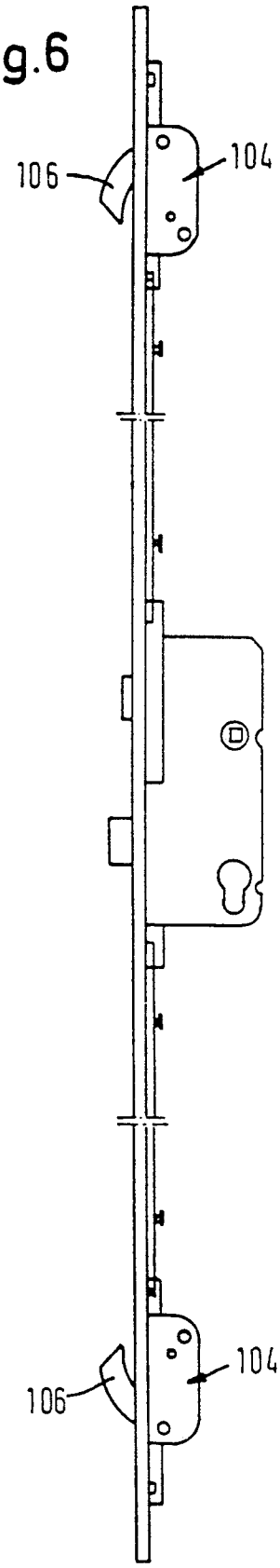
FIG. 6 shows an arrangement corresponding to FIG. 5 but with oppositely directed pivoting bolts.

FIGS. 4, 5 and 6 show an auxiliary lock 104 provided for multiple locking and equipped with a hook-shaped pivoting bolt 106. In the region of the auxiliary lock 104, the drive rod 10 has its narrow side guided on the faceplate 1 and is so cranked that it bears directly and in displaceable manner on the cover plate. On the broad side of the drive rod 10 which is remote from the cover plate, there is fixed (riveted) within the auxiliary lock a rack 108 which engages a toothed segment 110 which is integral with the pivoting bolt 106. The extended pivoting bolt 106 engages in known manner into a closer plate 112 on the frame side.

In FIG. 6, the hook-shaped pivot bolts 106 are disposed to move in the opposite direction compared with the arrangement shown in FIG. 5, a conventional reversing transmission being required.

Figure 7:
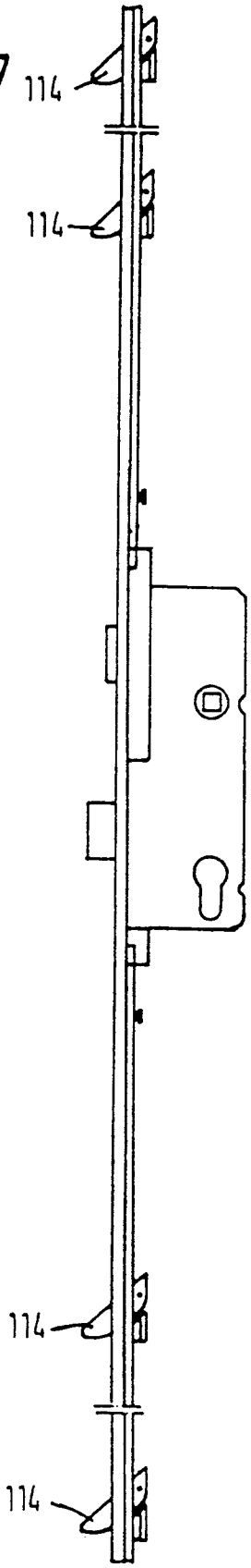
FIG. 7 shows an arrangement corresponding to FIG. 5 but with modified pivoting bolts.
Figure 8:
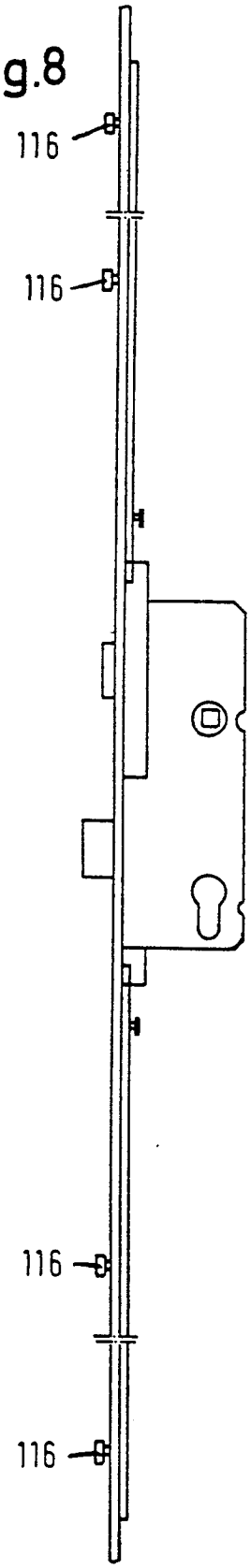
FIG. 8 shows an arrangement corresponding to FIG. 5 with a closure block rigidly mounted on the drive rod.

In FIG. 7, the additional bolts are constructed as prior art pivotable bolt tongues 114 while in FIG. 8 they are constructed as locking blocks 116.

Figure 9:
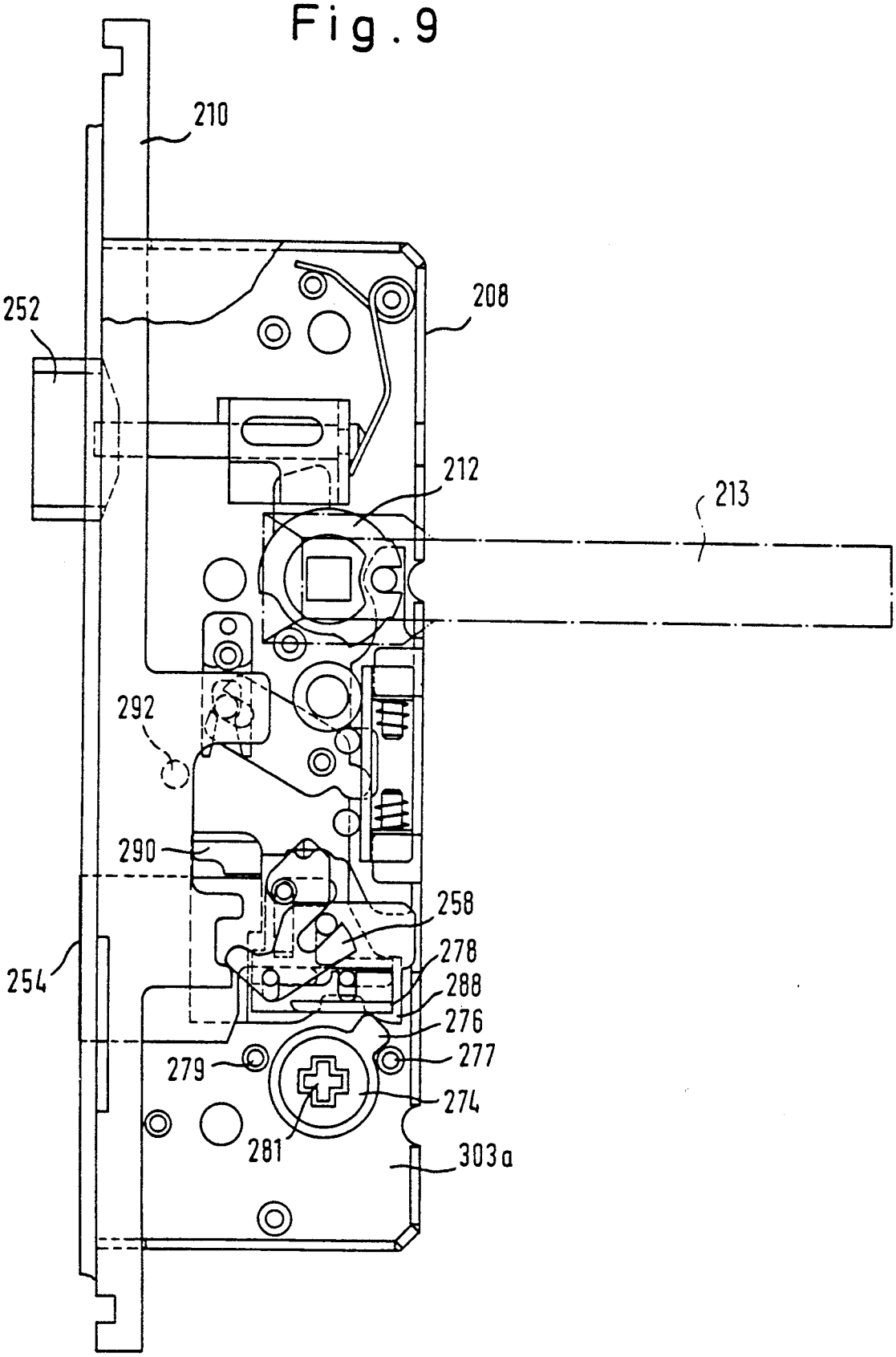
FIG. 9 shows a modification of the drive rod lock of FIG. 1.

FIG. 9 shows a modification with respect to FIG. 1.

Figure 10:
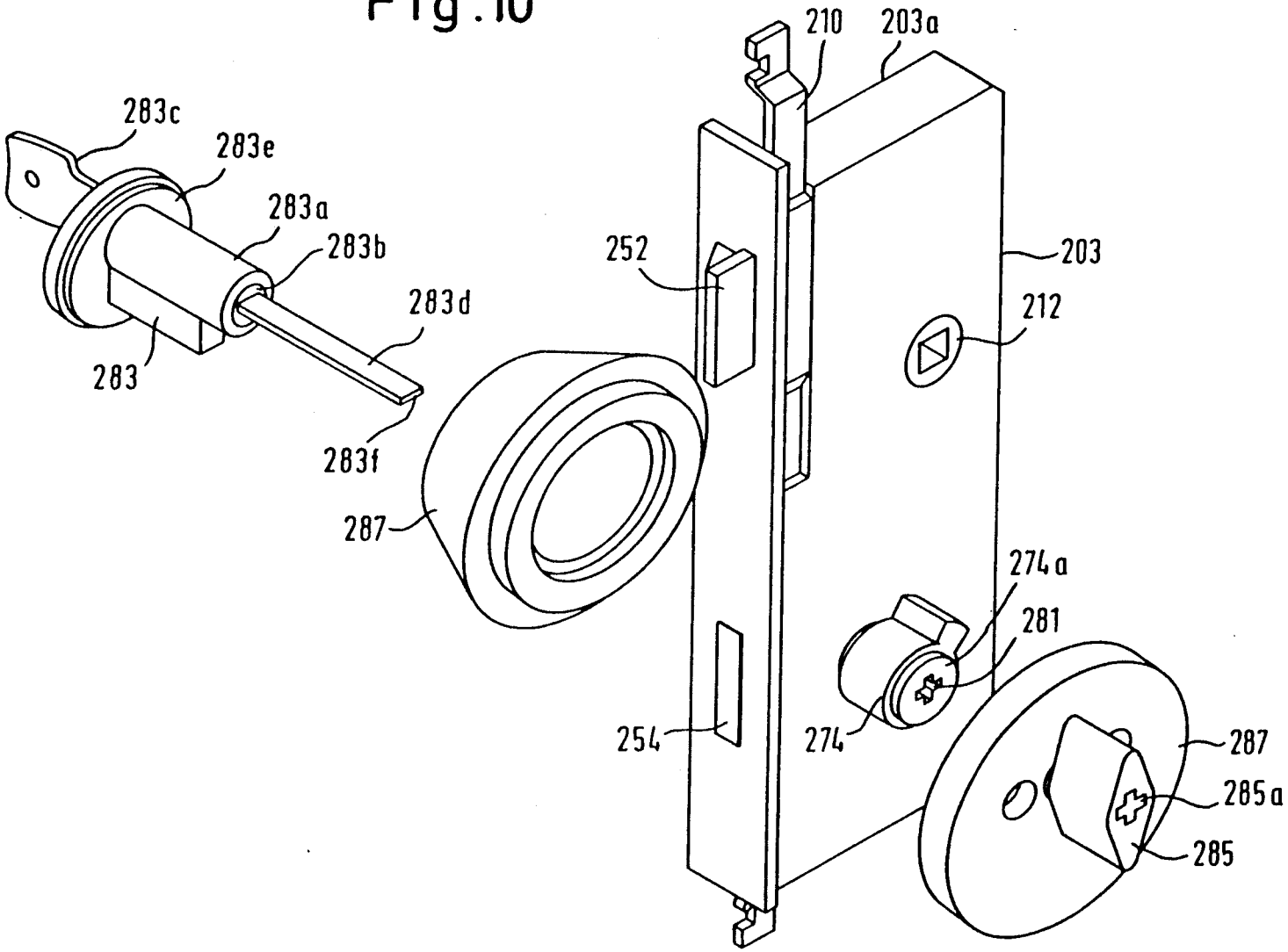
FIG. 10 shows the drive rod lock of FIG. 9 with a key-operated lock cylinder and a hand-operated switch member in a locking position of the drive rod.
Figure 11:
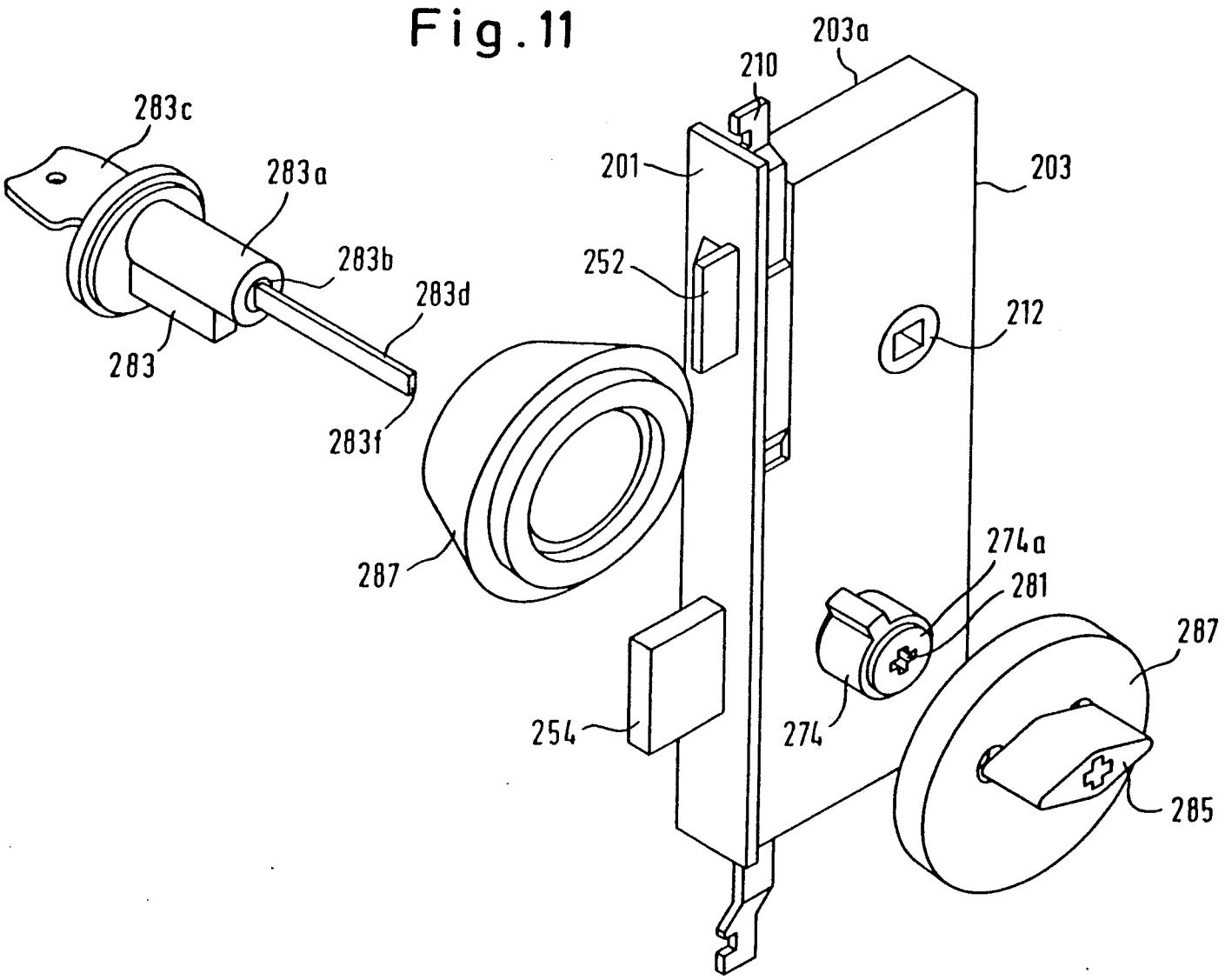
FIG. 11 shows the arrangement of FIG. 10 in an opening position of the drive rod.

The lock cylinder 74 of FIG. 1 has been replaced by a hub member 274 which is provided with a lock bit 276. The hub member 274 is angularly movable between a drive rod releasing position as shown in FIG. 9 and 10 and a drive rod locking position as shown in FIG. 11. In the drive rod releasing position according to FIG. 9, the lock bit 276 abuts against an abutment pin 277. In the drive rod locking position, the lock bit 276 abuts against a further abutment pin 279. The hub member 274 is rotatably mounted in the bottom plate 303*a* and in the lock cover (not shown). The lock bit 276 cooperates with the additional bolt 288 and with the latch 278, as described for respective components with respect to FIGS. 1, 2, 3.

When the drive rod 210 has been moved downwards into the locking position thereof corresponding to FIG. 2 by counterclockwise rotation of the handle bush and follower 212 and the bolt 254 has been shifted correspondingly into its extended position, as shown in FIG. 2, through the angle lever 258, the hub member 274 can be rotated in counterclockwise direction into the drive rod locking position thereof, i.e. into abutment with the abutment pin 279. Thus, the auxiliary bolt 288 is shifted to the left in FIG. 9 such that the dog 290 is located above the bolt 292. Thus, the drive rod 210 is secured again in its downward or locking position thereof. The behaviour of the latch 278 is identical as described in connection with FIGS. 1, 2, 3. Also all other functions of the drive rod lock are identical with those described in connection with FIGS. 1, 2, 3.

It is to be noted that the hub member 274 is arrested in the abutment positions engaging abutment pins 277 and 279 by the spring action of the latch 278.

The hub member 274 is provided with a cross-shaped central recess 281, the cross axes of which are horizontal and vertical, respectively, as shown in FIG. 9. The hub member 274 is rotatable through an angle of 90° between the two abutment pins 277 and 279 so that after a 90° rotation of the hub member 274, the cross axes are again in a vertical and a horizontal position, respectively.

The hub member 274 is intended and adapted for being coupled to a lock cylinder 283 and a switch member 285, as shown in FIGS. 10 and 11. The lock cylinder 283 comprises a cylinder casing 283*a* and a rotor member 283*b*. The rotor member 283*b* is provided with a slot (not shown) for receiving a key 283*c*. The rotor member 283*b* is provided with a coupling spike 283*d*. This coupling spike 283*d* has an angular free movement or play with respect to the rotor member 283*b* of at least 90°.

The cylinder casing 283*a* comprises a mounting flange 283*e* to be fastened to a side face of the respective door or window adjacent the bottom plate 203*a* of the lock housing 203. A spacer ring 287 is provided for insertion between the mounting flange 283*e* and the respective side face of the door or window. The coupling spike 283*d* is put through the cross-shaped recess 281 of the hub member 274 when the mounting flange 283*e* is fixed to the respective door or window. The free end 283*f* of the coupling spike 283*d* then extends beyond the end face 274*a* of the hub member 274 so that the switch member 285 can be coupled to the free end 283*f* of the coupling spike 283*d*. The switch member 285 is rotatably mounted on a mounting plate 287 which can be fastened to the other side of the respective door or window. The switch member 285 is provided with a cross-shaped recess 285*a* or a flat slot for receiving the coupling spike 283*d*.

The cross-shaped configuration of the recesses 281 and 285*a* allows various relative angular positions of the switch member 285 with respect to the cylinder lock 283 in the zero position thereof. Preferably, the relative angular positions are selected so that in the drive rod releasing position (FIG. 9) of the hub member 274, the switch member 285 has the position as shown in FIG. 10 with the long cross-sectional axis thereof extending vertically, whereas in the drive rod locking position of the hub member 274, as shown in FIG. 11, the switch member 285 assumes the position of FIG. 11 with the long cross-sectional axis thereof extending horizontally.

Preferably, the lock cylinder 283 is provided on the outer side face of the respective door or window, whereas the switch member 285 is provided on the inner side face of the respective door or window. If a person leaves the respective house, the handle bush and follower 212 is rotated by 90° so that the drive rod 210 and the bolt 254 are displaced from their opening positions, as shown in FIG. 10, to their locking positions, as shown in FIG. 11. Thereupon the key 283*c* may be rotated by 90° so that the hub member 274 is rotated from the position of FIG. 10 corresponding to the position of FIG. 9 into the position of FIG. 11. Thus the hub member 274 is moved into its drive rod locking position corresponding to FIG. 11 and the auxiliary bolt 278 of FIG. 9 is moved into its drive rod locked position corresponding to the position of the auxiliary bolt 88 in FIG. 2. Thereupon the key 283*c* can be rotated back into the zero position of the rotor member 283*b*. This backward rotation has no effect on the hub member 274 due to the angular 90° play provided between the coupling spike 283*d* and the rotor member 283*b*. Thus the drive rod lock remains in its secured locking position and the key 283*c* can be withdrawn. In the secured locking position as shown in FIG. 11, handle bush and follower is locked against rotation, in the opening sense, as described in connection with FIGS. 1, 2, 3. In the unlocked condition, as shown in FIG. 10, the hub member 274 is prevented from being rotated into the angular position of FIG. 11 as described in connection with FIGS. 1, 2, 3.

When the person wants to open the door again, the key 283*c* is rotated from the position shown in FIG. 10 in opposite sense. The coupling spike 283*d* follows immediately because the angular play between the coupling spike 283*d* and the rotor member 283*b* has already been consumed after the precedent locking operation by returning the key 283*c* into the zero angular position of the rotor member 283*b*.

When a person wants to lock the door after having entered the respective house, the switch member 285*c* can be rotated so as to turn the hub member 274 from the position of FIG. 10 to the position of FIG. 11. This is possible even if the key 283*c* is withdrawn due to the angular play between the coupling spike 283*d* and the rotor member 283*b*. Unlocking of the door is possible by rotation of the hub member 274 in the opposite sense through the switch member 285.

Figure 3:
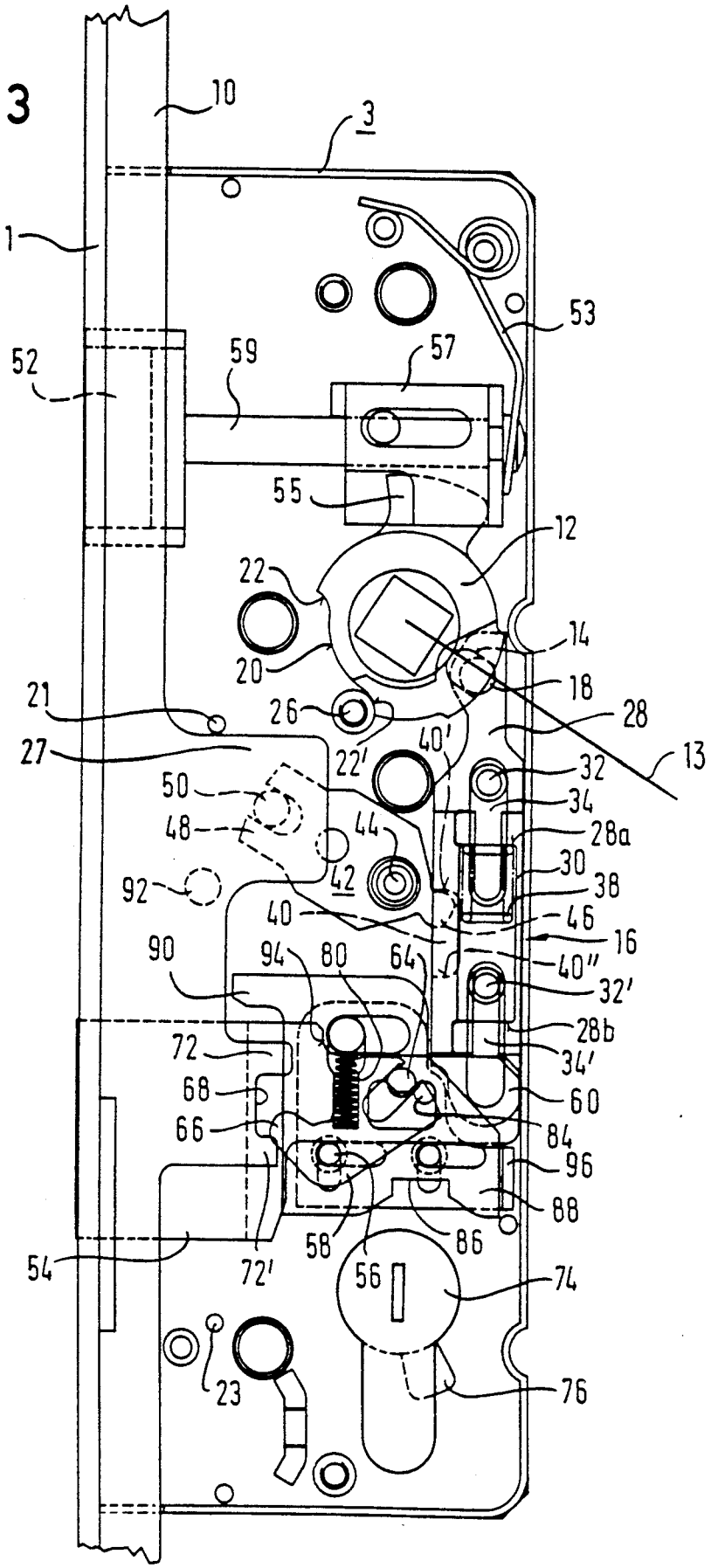
FIG. 3 shows the drive rod lock according to FIG. 1 and 2 after rotation of the handle bush and follower through 45° in a clockwise direction, withdrawal of the latch, displacement of the drive rod into the opening position and withdrawal of the bolt into the retracted position.

In FIGS. 9, 10, and 11 the same reference numerals are used as in FIGS. 1 to 3 increased by two-hundred.

In the embodiment of FIGS. 12 to 17, analogous parts have been designated by the same reference numbers as in FIG. 1 increased by 400.

The control element 416 and the latch bolt 452 are driven by the handle bush and follower 412 in the same way as described in connection with the preceding figures. The handle bush and follower 412 is provided with a handle or knob 413 by which the handle bush and follower 412 can be rotated.

Figure 12:
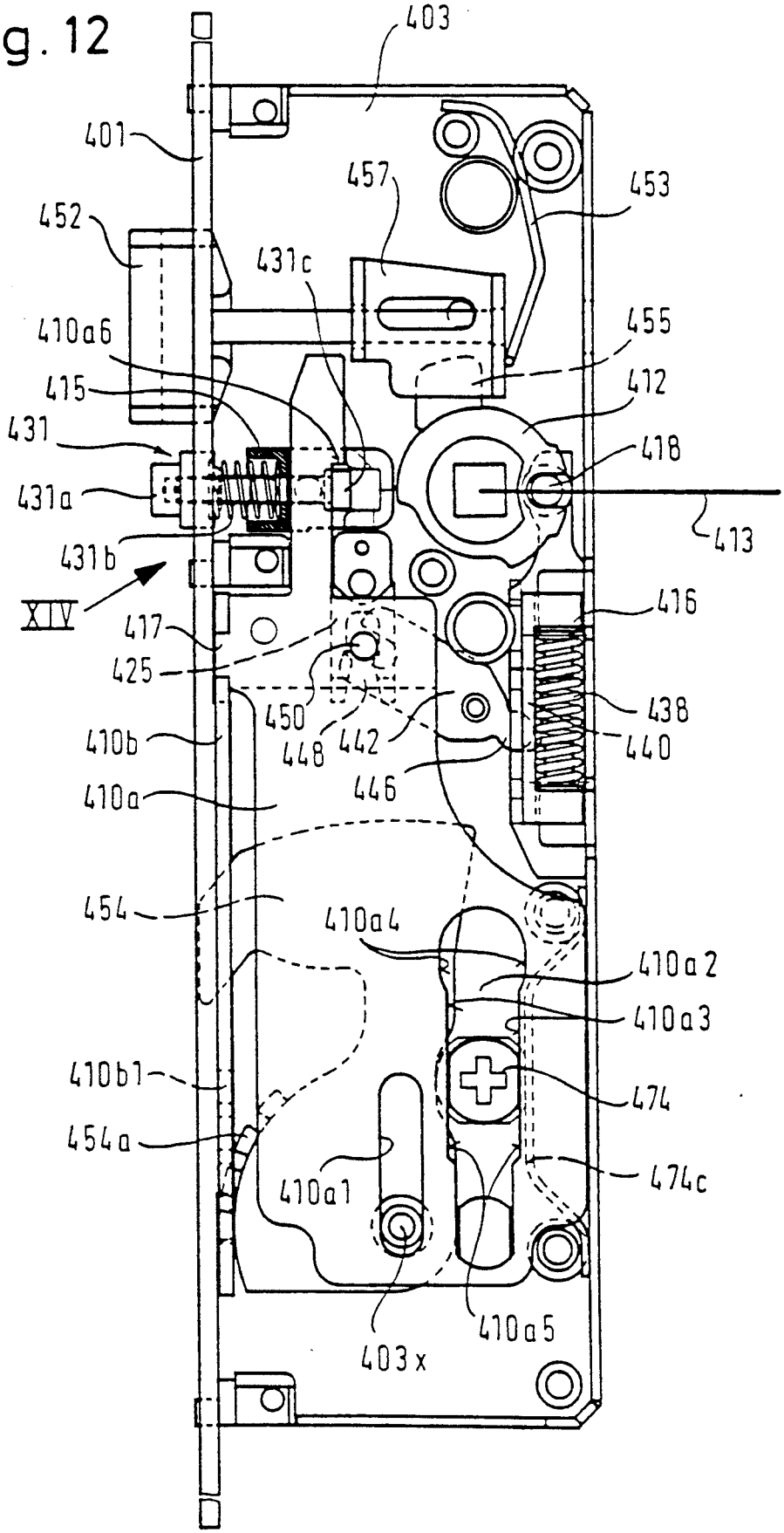
FIG. 12 shows a lock assembly similar to that of FIGS. 1 and 9 in an opening position.

The double-armed lever 442 is shaped as in the above-described figures and engages by its short lever arm 446 the elongate marginal recess 440 of the control element 416, as described above. The long lever arm 448 engages the stud 450, which is mounted on a drive plate 410*a*. The drive plate 410*a* is guided within the housing 403 by an elongate aperture 410*a*1 on a stud 403*x* mounted in the housing 403 and by a guiding block 415 in a direction parallel to the longitudinal direction of the face plate 401. The drive plate 410*a* is connected with a drive rod 410*b* by entraining elements 417. The drive rod 410*b* lies with its broad side against the face plate 401 and is guided by this face plate 401. The drive rod 410*b* is in its lower section, as shown in FIG. 12, shaped as a rack 410*b*1. A pivoting bolt 454 is pivotally mounted about the stud 403*x*. This pivoting bolt 454 is provided with a pinion or a 454*a* meshing with the rack 410*b*1.

Figure 16:
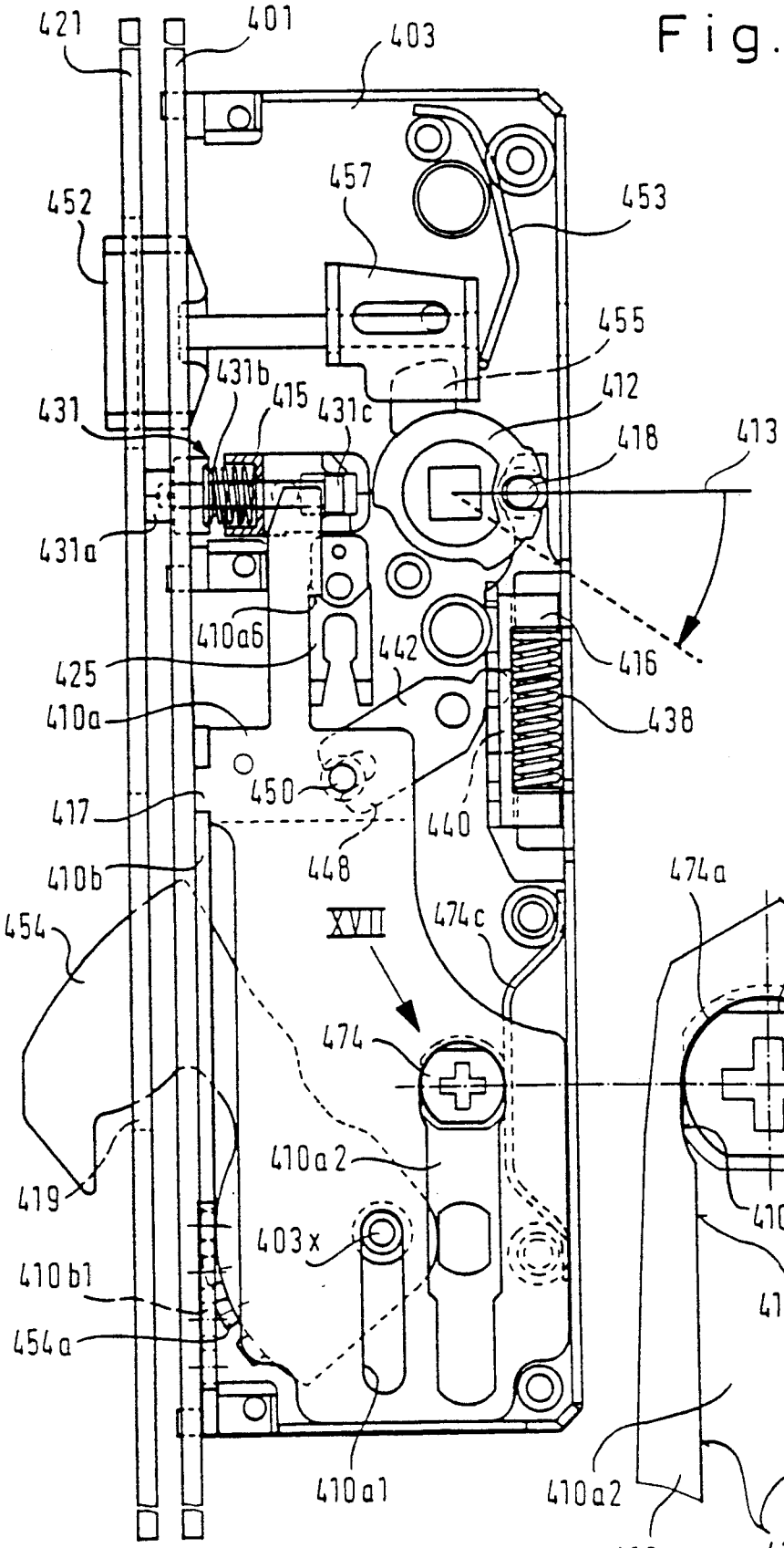
FIG. 16 shows the embodiment of FIG. 12, when the window or door is locked

By turning the handle bush and follower 412 in the anti-clockwise sense, the lever 442 is pivoted in the anti-clockwise sense so that the drive plate 410*a* and the drive rod 410*b* are displaced downwards and the pivoting bolt 454 is pivoted from its retracted position as shown in FIG. 12 to its advanced position as shown in FIG. 16. This pivoting bolt 454 passes through an aperture of the drive rod 410*b* (not shown) and through a further aperture of the face plate 401 (not shown). When pivoted in the advanced position as shown in FIG. 16, the pivoting bolt 454 enters into an aperture 419 of a locking plate 421 as shown in FIG. 16. This locking plate may be a part of a stationary door or window frame or a part of an opposite door or window wing.

When the handle bush and follower 412 is released by the hand of the operator, it returns into the position as shown in FIG. 12, whereas the pivoting bolt 454 remains in the advanced position as shown in FIG. 16.

When the handle bush and follower 412 is rotated in clockwise direction starting from the position as shown in FIG. 12, the latch bolt 452 is withdrawn inwards of the housing 403, and the pivoting bolt 454 is retracted into the retracted position of FIG. 12.

In the position of FIG. 12, the drive plate 410*a* is arrested in its opening position as shown by a fork-shaped elastic arresting member 425, which encompasses the stud 450 fastened to the drive plate 410*a*. So it is made sure that the drive plate 410*a* cannot be moved unintentionally from the opening position as shown in FIG. 12 to its locking position as shown in FIG. 16.

The drive plate 410*a* is provided with a longitudinal slot 410*a*2, which defines two control profiles 410*a*3. These control profiles 410*a*3 are provided for cooperation with a hub member 474 shown in larger scale in FIG. 17. The hub member 474 is rotatably mounted in the housing 403 between a releasing angular position as shown in FIG. 12 and a locking angular position as shown in FIGS. 16 and 17.

When the drive plate 410*a* is in its downward locking position as shown in FIG. 16, the hub member 474 can be rotated between its locking angular position and its releasing angular position. The hub member 474 has an annular engagement zone with arc-shaped sections 474*a* and flattened sections 474*b*. In the locking position of FIGS. 16 and 17, the arc-shaped sections 474*a* of the hub member 474 are positioned opposite to curved portions 410*a*4 of the control profiles 410*a*3. By engagement of said arc-shaped sections 474*a* of the hub member 474 with the curved portions 410*a*4 of the control profiles 410*a*3, an upward movement of the drive plate 410*a* from the locking position as shown in FIG. 16 towards the opening position as shown in FIG. 12 is prevented. This means that the drive plate 410*a* and the drive rod 410*b* are locked in their downward or locking position as shown in FIG. 16. It is not possible to rotate the handle 413 from the rest position as shown in full line in FIG. 16 towards the position as shown in dotted lines in FIG. 16, because the handle bush and follower 412 is locked via the control element 416 and the lever 442 by the drive plate 410*a*, which drive plate is locked by the hub member 474 positioned in its drive unit locking angular position. This means that the drive plate 410*a* and the drive rod 410*b* are secured in their downward or locking position, and the pivoting bolt 454 is secured in its advanced position. The non-rotatability of the handle bush and follower 412 in the clockwise direction gives the user an indication that the lock assembly is locked and secured in the locking condition.

Figure 13:
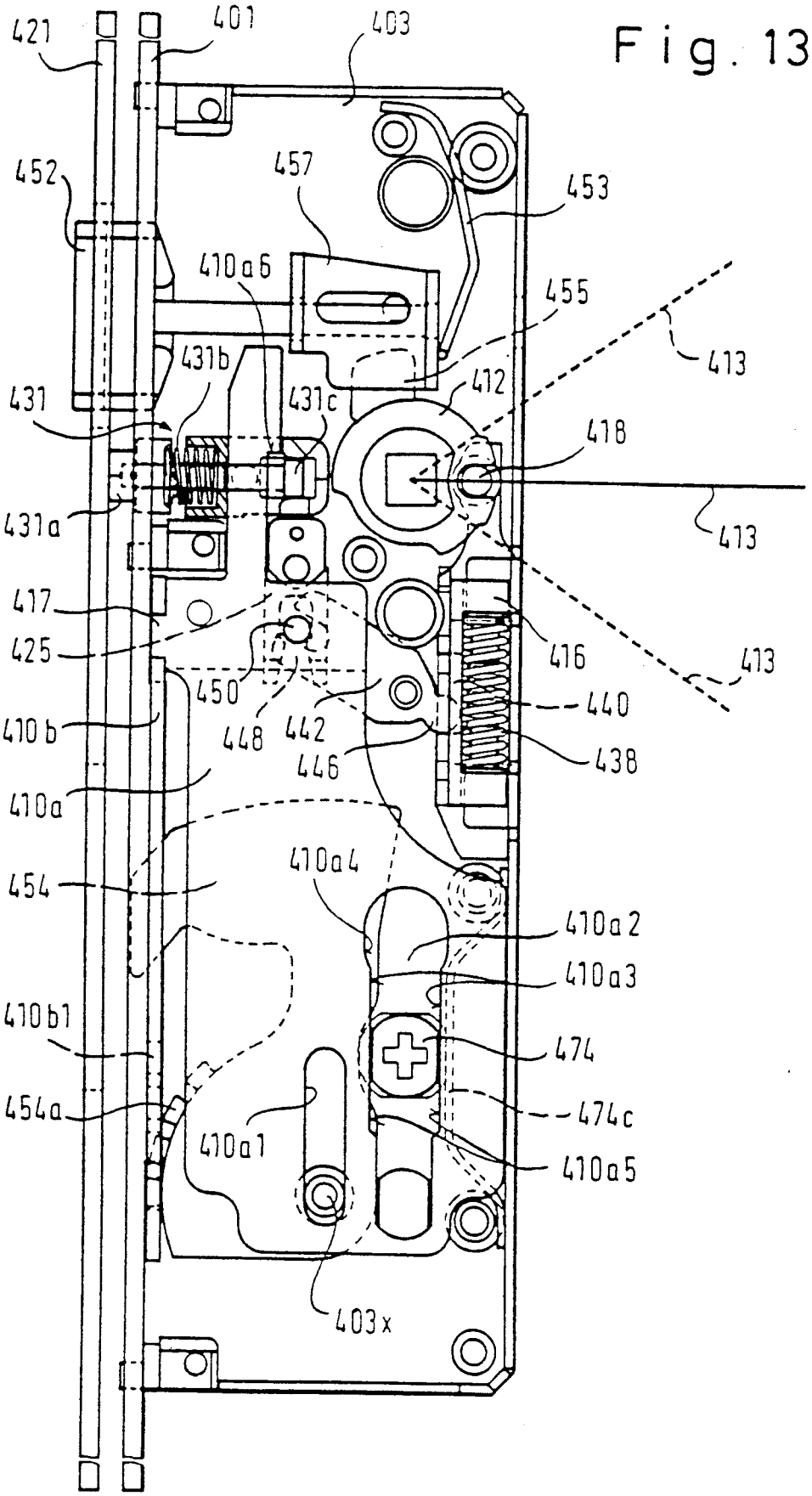
FIG. 13 shows the embodiment of FIG. 12, after the window or door has been closed.
Figure 17:
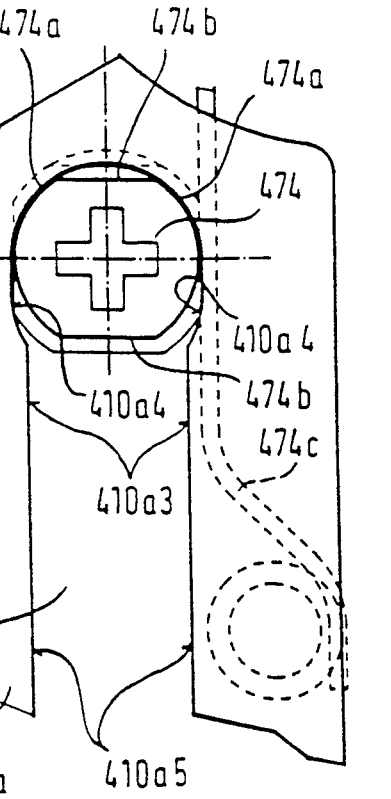
FIG. 17 shows a detail of FIG. 16 at XVII.

If the user wants to open the door starting from the situation in FIG. 16, he must first of all rotate the hub member from the drive unit locking angular position as shown in FIG. 17 to the drive unit releasing angular position as shown in FIGS. 12 and 13. Then the handle bush and follower 412 can be rotated in the anti-clockwise sense towards the dotted position of the handle 413 as shown in FIG. 13 so that the drive plate 410*a* is moved upwards through the control element 416 and the lever 442 towards the position as shown in FIGS. 12 and 13.

When the position of the FIGS. 12 and 13 is reached, the hub member 474 engages by its flattened sections 474*b* straight portions 410*a*5 of the control profiles 410*a*3 so that rotation of the hub member 474 from the drive unit releasing angular position as shown in FIGS. 12 and 13 towards the drive unit locking angular position as shown in FIGS. 16 and 17 is not possible. This means that the user is sure, when he can rotate the hub member 474 from the drive unit releasing angular position as shown in FIGS. 12 and 13 to the drive unit locking angular position as shown in FIG. 16, that the drive plate 410*a* and the drive rod 410*b* are in the respective locking positions and the pivoting bolt 454 is in its advanced position.

The hub member 474 is secured against unintentional rotation between the drive unit locking angular position and its drive unit releasing angular position by a longitudinal spring member 474*c* engaging flattened zones of the circumference of the hub member 474, which are provided in an annular zone of the hub member 474 axially of that with respect to the annular area providing the arc-shaped sections 474*a* and the flattened sections 474*b*.

A sensor unit 431 is provided adjacent the face plate 401. This sensor unit comprises a sensor member 431*a* which is biased by a sensor spring 431*b* towards an advanced position projecting beyond the face plate 401. This sensor member 431*a* is provided with a dock member 431*c*. This dock member 431*c* is located in FIG. 12 below a shoulder 410*a*6 of the drive plate 410*a*. This means that the drive plate 410*a* is locked against downward movement from its opening position as shown in FIG. 12 towards its locking position as shown in FIG. 16. When the user tries to rotate the handle bush and follower 412 in the anti-clockwise direction, he feels that the handle bush and follower 412 is blocked by the drive plate 410*a* through the lever 442 and the control element 416, because the drive plate 410*a* is blocked by the engagement of the dock member 431*c* below the shoulder 410*a*6. The user knows therefrom that the door is not closed, and it is impossible that the user can bring the pivot bolt 454 into the advanced position in thinking that the window or door was closed, when the window or door is not closed.

Manipulation of the sensor member 431*a* while the window or door is opened does not result in an unintended movement of the drive plate 410*a* into its locking position and respectively of the pivoting bolt 454 into its advanced position due to the securing function of the arresting member 425.

Figure 15:
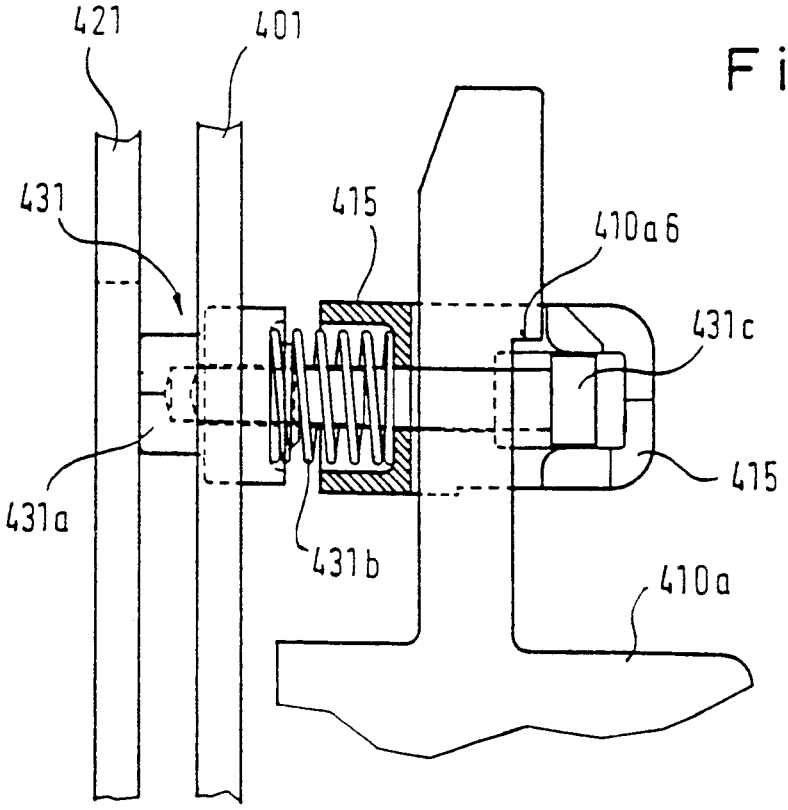
FIG. 15 shows the detail, when the window or door is closed.

Assuming now that the window or door is brought from an open position as shown in FIG. 12 to a closed position as shown in FIG. 13, the sensor member 431*a* engages the locking plate 421 so that the dock 431*c* is displaced to the right as shown in FIGS. 13 and 15. So, the drive plate 410*a* becomes free for downward movements towards its locking position. This means that the user can bring now the drive plate 410*a* of the handle bush and follower 412 in anti-clockwise direction through the control element 416 and the lever 442 in the downward or locking position and thereby rotate the pivoting bolt 454 into the advanced position as shown in FIG. 16.

The latch bolt 452 and the sensor member 431*a* can be rotated by 180° so that the lock assembly can be used both for right-hand and left-hand door or window wings.

Figure 14:
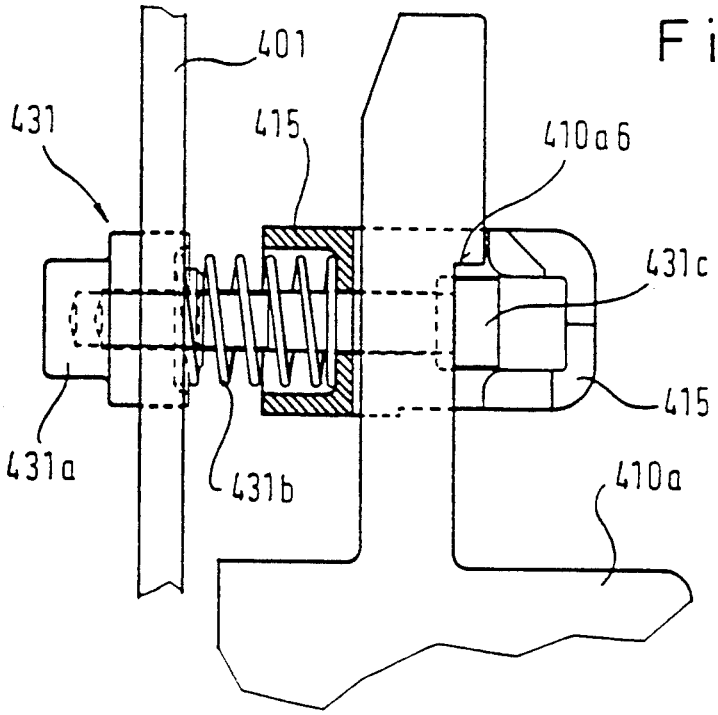
FIG. 14 shows a detail of FIG. 12 at XIV, when the window or door is open.

As can be seen particularly from FIGS. 14 and 15, the drive plate 410*a* is guided by a guiding block 415, which is simultaneously the carrier 415 of the sensor unit 431.

The hub member 474 is operated by a locking cylinder as shown in FIG. 10 and designated by 283 and by a switch member as shown in FIG. 10 and designated by 285.

All statements with respect to FIGS. 10 and 11 concerning the construction and operation of the lock cylinder 283 and the switch member 285 are also true for the embodiment of FIGS. 12 to 16.

This invention is not restricted to the above described examples. Variations are possible without leaving the scope of protection.

The reference numerals used in the claims are only intended for a better understanding of the invention and are not restrictive.

What is claimed is:

1. A drive rod lock for doors or windows with a housing (3), a handle bush and follower (12) rotatable by a handle or knob (13) and mounted to rotate about an axis at right-angles to the door or window surface, a restoring spring (38) which so pretensions the handle bush and follower (12) into a rest position that it can be rotated in opposite directions of rotation out of the rest position, a drive rod (10) guided lengthwise of a face plate (1) on the housing (3) and serving to control lock elements, a transmission linkage (16, 42) comprising clearance defining means and, connecting the handle bush and follower (12) to the drive rod (10) said transmission linkage (16, 42) comprising a transmission lever (42) serving to displace the drive rod (10), rotation of the handle bush and follower (12) in a first direction of rotation causing displacement of the drive rod (10) into a locking position, and rotation of the handle bush and follower (12) in a second direction of rotation causing displacement of the drive rod (10) into an opening position, said clearance defining means (40', 40'', 46) in the transmission linkage (16, 42), after entry of the drive rod into the relevant drive rod position and upon release of the handle or knob (13), allowing a return of the handle bush and follower (12) through the restoring spring (38) into its rest position while leaving the drive rod (10) in whichever drive rod position has been reached, said transmission linkage (16, 42) comprising a control element (16) guided in the vicinity of a limiting edge (3*c*) of the housing (3) disposed opposite the face plate (1) parallel with the drive rod (10), said control element (16) being coupled substantially without clearance to the handle bush and follower (12), said restoring spring (38) engaging said control element (16), said transmission lever (42) being constructed as a two-armed transmission lever (42) which is rockably mounted at a location between the drive rod (10) and the control element (16) on the housing, a first shorter lever arm (46) being, with clearance, in engagement with the control element (16), a longer lever arm (48) engaging the drive rod (10).

2. A drive rod lock as set forth in claim 1, wherein the handle bush and follower (12) acts upon a latching bolt (52) which is pretensioned by a latch bolt spring (53) in the direction of an advanced position.

3. A drive rod lock as set forth in claim 1, wherein the drive rod (10) is operationally coupled to a bolt (54) guided for displacement in the housing (3) at right-angles to the face plate (1) and being adapted for movement between an advanced position corresponding to the locking position of the drive rod (10) and a retracted position corresponding to the opening position of the drive rod (10).

4. A drive rod lock as set forth in claim 3, wherein between the drive rod (10) and the bolt (54) there is a transmission gearing (58,64,68,72,72') which is subject to dead movement so that upon displacement of the drive rod (10) in the direction towards its locking position the bolt (54) driven by the drive rod (10) reaches its advanced position before the drive rod (10) reaches its locking position and wherein there are mounted on the drive rod (10) and the bolt (54) locking securing elements (92,94) which, after the bolt (54) has entered its advanced position and during the subsequent residual movement of the drive rod (10) in the direction towards its locking position, come into engagement and prevent the return of the bolt (54) into its retracted position.

5. A drive rod lock as set forth in claim 1, wherein said lock housing (10) comprises accommodating means for a locking unit (74) and more particularly a lock cylinder (74) which makes it possible to prevent displacement of the drive rod (10) out of its locking position into its opening position.

6. A drive rod lock as set forth in claim 5, wherein the locking unit (74) has a bit (76) which acts on an auxiliary bolt (88) which-is adapted for displacement transversely to the longitudinal direction of the drive rod (10) between a drive rod released position and a drive rod locked position and which, in the drive rod locked position, engages a drive rod locking member (92) mounted on the drive rod (10).

7. A drive rod lock as set forth in claim 6, wherein the lock bit (76) of the locking unit (74) with phase displacement relative to its action on the auxiliary bolt (88) also acts on a spring-loaded latch (78) for the auxiliary bolt (88) which locks the auxiliary bolt (88) against movement at least when the auxiliary bolt (88) assumes the drive rod locking position.

8. A drive rod lock as set forth in claim 1, wherein the restoring spring (38) comprises at least one coil thrust spring which, in a rest position of the control element (16) corresponding to the rest position of the handle bush and follower (12) has both ends bearing on respective studs (32,32') of the housing and respective abutments (28*a*,28*b*) of the control element (16).

9. A drive rod lock as set forth in claim 8, wherein the control element (16) comprises a drive dog (18) which engages a radially elongated marginal recess (14) in the handle bush and follower (12).

10. A drive rod lock as set forth in claim 9, wherein in the rest position of the handle bush and follower (12) the connecting line between the axis of rotation of the handle bush and follower (12) and the axis of the drive dog (18) is approximately at right-angles to the direction of displacement of the control element (16).

11. A drive rod lock as set forth in claim 1, wherein the handle bush and follower (12) is capable of being rotated through about 45° from the rest position in order to establish the locking position or opening position respectively, of the drive rod (10).

12. A drive rod lock as set forth in claim 7, wherein when the bolt (54) is retracted, the latch (78) is blocked by a part of the bolt (54) or a part of a bolt tail (60) connected to it so that when the bolt (54) is retracted, rotating the lock cylinder in a locking direction is impossible.

13. A drive rod lock as set forth in claim 5, wherein when the locking position of the drive rod (10) is secured by the locking unit (74), the handle or knob (13) is blocked by the drive rod (10) through the transmission lever (42) so that it cannot be rotated out of the rest position in the second direction of rotation.

14. A drive rod lock as set forth in claim 1, wherein in the opening position the drive rod (10) is secured against unintended displacement by an interlocking catch arrangement (25, 29, 50).

15. A drive rod lock as set forth in claim 1 wherein the drive rod (10) is positioned in the opening position and in the closing position by abutments (21, 23).

16. A lock assembly for doors or windows with a housing (3), a handle bush and follower (12) rotatable by a handle or knob (13) and mounted to rotate about an axis at right-angles to the door or window surface, a restoring spring (38) which so pretensions the handle bush and follower (12) into a rest position that it can be rotated in opposite directions of rotation out of the rest position, a drive unit (10) guided lengthwise of a face plate (1) on the housing (3) and serving to control at least one lock element, and a transmission linkage (28, 42) comprising clearance defining means and connecting the handle bush and follower (12) with the drive unit (10), said transmission linkage (28, 42) comprising a transmission lever (42) and serving to displace the drive unit (10), rotation of the handle bush and follower (12) in a first direction of rotation causing displacement of the drive unit (10) into a locking position, and rotation of the handle bush and follower (12) in a second direction of rotation causing displacement of the drive unit (10) into an opening position, said clearance defining means (40', 40'', 46) in the transmission linkage (28, 42), after entry into the relevant drive unit position and upon release of the handle or knob (13), allowing a return of the handle bush and follower (12) through the restoring spring (38) into its rest position while leaving the drive unit (10) in whichever drive rod position has been reached, said lock assembly further comprising accommodating means for accommodating a locking unit (74), which is rotatable between a drive unit releasing angular position and a drive unit locking angular position.

17. A lock assembly as set forth in claim 16, said locking unit (74) having a bit (76) which acts on an auxiliary bolt (88) which is adapted for displacement transversely to the guiding direction of the drive unit (10) between a drive unit released position and a drive unit locked position and which, in the drive unit locked position, engages a drive unit locking member (92) mounted on the drive unit (10).

18. A lock assembly as set forth in claim 16, said locking unit comprising a hub member (274), which is rotatable between a drive unit releasing angular position and a drive unit locking angular position about an axis substantially perpendicular to the respective door or window surface.

19. A lock assembly as claimed in claim 18, said hub member (274) comprising a bit (276) which acts on an auxiliary bolt (288), which is adapted for displacement transversely to the guiding direction of the drive unit (210) between a drive unit released position and a drive unit locked position.

20. A lock assembly as set forth in claim 16, said locking unit comprising a hub member (274) being elastically arrestable in said drive unit releasing angular position and in said drive unit locking angular position.

21. A lock assembly as set forth in claim 18, said hub member (274) comprising coupling means (281) for being coupled to a hand-operated switch member (285).

22. A lock assembly as set forth in claim 21, said coupling means (281) comprising a non-circular recess (281) extending through said hub member (274) along the axis of rotation thereof and being adapted to receive a coupling spike (283*d*).

23. A lock assembly as set forth in claim 22, said non-circular recess (281) having a substantially cross-shaped cross-sectional area.

24. A lock assembly as set forth in claim 18, said hub member (274) having coupling means (281) for being coupled to a cylinder lock (283) to be fixed with respect to one of said housing (203) and said door or window.

25. A lock assembly as set forth in claim 24, said coupling means (281) comprising a non-circular recess (281) extending through said hub member (274) along the axis of rotation thereof.

26. A lock assembly as set forth in claim 25, said non-circular recess (281) having a substantially cross-shaped cross-sectional area.

27. A lock assembly as set forth in claim 18, said hub member (274) being coupled for common rotation to both a hand-operated switch member (285) provided adjacent a first side face of said housing and a key-operated lock cylinder (283) provided adjacent a second side face of said housing.

28. A lock assembly as set forth in claim 27, said key-operated lock cylinder (283) having a rotor member (283*b*) with a key (283*c*) receiving slot, the key (283*c*) being withdrawable from said slot only in a zero angular position of said rotor member (283*b*) with respect to said lock cylinder, said rotor member (283*b*) being coupled to said hub member (274) by coupling means (283*d*, 281) permitting angular play between said rotor member (283*b*) and said hub member (274), said angular play corresponding at least to the angular distance between said drive unit locking position and said drive unit releasing position of said hub member (274).

29. A lock assembly as set forth in claim 27, said lock cylinder (283) being provided with a coupling spike (283*d*) extending through a coupling recess (281) of said hub member (274), said hand-operated switch member (285) being fixable on an end portion (283*f*) of said coupling spike (283*d*).

30. A lock assembly as set forth in claim 18, said hub member (274) being angularly movable through an angle of about 90°.

31. A lock assembly as set forth in claim 21 or claim 27, said hand-operated switch member (285) having a non-circular shape allowing the identification of the angular position of said hand-operated switch member (285).

32. A lock assembly as set forth in claim 17 or 19, said bit (76) of said locking unit (74) with phase displacement relative to its action on the auxiliary bolt (88) also acts on a spring-loaded latch (78) for the auxiliary bolt (88) which locks the auxiliary bolt (88) against movement at least when the auxiliary bolt (88) assumes the drive rod locked position.

33. A lock assembly as set forth in claim 16, wherein the transmission linkage (28, 42) comprises a control element (16) guided in the vicinity of a limiting edge (3*c*) of the housing (3) disposed opposite the face plate (12) parallel with the guiding direction of the drive unit (10), and wherein said control element (16) is coupled substantially without clearance to the handle bush and follower (12), said restoring spring (38) engages said control element (16) and said transmission lever (42) is constructed as a two-armed transmission lever (42) which is rockably mounted at a location between the face plate (1) and the control element (16) on the housing, a first shorter lever arm (46) being, with clearance, in engagement with the control element (16) and a longer lever arm (48) engaging the drive rod (10).

34. A lock assembly as set forth in claim 33, wherein the handle bush and follower (12) acts upon a latching bolt (52) which is pretensioned by a latch bolt spring (53) in the direction of an advanced position.

35. A lock assembly as set forth in claim 16, wherein the drive unit (10) is operationally coupled to a bolt (54) guided for displacement in the housing (3) at right-angles to the face plate (1), said bolt (54) being adapted for movement between an advanced position corresponding to the locking position of the drive unit (10) and a retracted position corresponding to the opening position of the drive unit (10).

36. A lock assembly as set forth in claim 35, wherein between the drive unit (10) and the bolt (54) there is a transmission gearing (58, 64, 68, 72, 72') which is subject to dead movement so that upon displacement of the drive unit (10) in the direction towards its locking position the bolt (54) driven by the drive unit (10) reaches its advanced position before the drive unit (10) reaches its locking position and wherein there are mounted on the drive unit (10) and the bolt (54) locking securing elements (92,94) which, after the bolt (54) has entered its advanced position and during the subsequent residual movement of the drive unit (10) towards its locking position come into engagement and prevent the return of the bolt (54) into its retracted position.

37. A lock assembly as set forth in claim 33, wherein the restoring spring (38) comprises at least one coil thrust spring which, in a rest position of the control element (16) corresponding to the rest position of the handle bush and follower (12), has both ends bearing on respective studs (32,32') of the housing and respective abutments (28*a*, 28*b*) of the control element (28).

38. A lock assembly as set forth in claim 37, wherein said control element (16) comprises a drive dog (18) which engages a radially elongated marginal recess (14) in the handle bush and follower (12).

39. A lock assembly as set forth in claim 38, wherein in the rest position of the handle bush and follower (12) the connecting line between the axis of rotation of the handle bush and follower (12) and the axis of the drive dog (18) is approximately at right-angles to the direction of displacement of the control element (16).

40. A lock assembly as set forth in claim 16, wherein the handle bush and follower (12) is capable of being rotated through about 45° from the rest position in order to establish the locking position or opening position, respectively, of the drive unit (10).

41. A lock assembly as set forth in claim 32, said drive unit (10) being operationally coupled to a bolt (54) guided for displacement in the housing (3) at right-angles to the face plate (1), said bolt (54) being adapted for movement between an advanced position corresponding to the locking position of the drive unit (10) and a retracted position corresponding to the opening position of the drive unit (10), a transmission gearing (58,64,68,72,72') being provided between the drive unit (10) and the bolt (54), which transmission gearing is, subject to dead movement, so that upon displacement of the drive unit (10) in the direction towards its locking position, the bolt (54) driven by the drive unit (10) reaches its advanced position, before the drive unit (10) reaches its locking position, locking securing elements (92,94) being mounted on the drive unit (10) and the bolt (54), said locking securing elements (92,94) coming into engagement and preventing the return of the bolt (54) into its retracted position, after the bolt (54) has entered into its advanced position during the subsequent residual movement of the drive unit (10) towards its locking position.

42. A lock assembly as set forth in claim 41, wherein, when the bolt (54) is in its retracted position, the lash (78) is blocked by a part of the bolt (54) or a part of a bolt tail (60) connected to the bolt so that when the bolt (54) is retracted, rotation of the locking unit (74) is impossible.

43. A lock assembly as set forth in claim 16, wherein, when the locking position of the drive rod (10) is secured by the locking unit (74), the handle or knob (13) is blocked by the drive unit (10) through the transmission lever (42) so that it cannot be rotated out of the rest position in the second direction of rotation.

44. A lock assembly as set forth in claim 16, wherein in the opening position the drive unit (10) is secured against unintended displacement by an interlocking catch arrangement (25,29,50).

45. A lock assembly as set forth in claim 16, wherein the drive rod (10) is positioned in the opening position and in the closing position by abutments (21,23).

46. A lock assembly as set forth in claim 16, said drive unit comprising a drive rod (10).

47. A lock assembly as set forth in claim 46, said drive rod (10) being continued beyond said housing (3) and controlling movement of at least one auxiliary lock element (106;114;116) outside said housing (3).

48. A lock assembly as set forth in claim 16, said drive unit (410*a,b*) having at least one control profile (410*a*3) extending substantially parallel to said face plate (401), said control profile (410*a*3) cooperating with a hub member (474) engaging said control profile (410*a*3), said hub member (474) being rotatably mounted in said housing (403) between a drive unit releasing angular position and a drive unit locking angular position, said control profile (410*a*3) and said hub member (474) being shaped such that at least one of the below-mentioned requirements is fulfilled:

a) only in said locking position of said drive unit (410*a,b*), said hub member (474) is rotatable between its drive unit releasing angular position and its drive unit locking angular position;

b) movement of said drive unit (410*a,b*) from its locking position towards its opening position is only possible, when said hub member (474) is in said drive unit releasing angular position and c) in positions of said drive unit (410*a,b*) remote from said locking position, a rotation of said hub member (474) from said drive unit releasing angular position towards said drive unit locking angular position is prevented.

49. A lock assembly as set forth in claim 48, said control profile (410*a*3) being provided by an elongated hole (410*a*2) of said drive unit (410 *a,b*), said hub member (474) penetrating the elongated hole (410*a*2).

50. A lock assembly as set forth in claim 49, said elongated hole (410*a*2) providing control profiles (410*a*3) on mutually opposite edges thereof.

51. A lock assembly as set forth in claim 48, said hub member (474) having an annular engagement zone (474*a*) engageable with said at least one control profile (410*a*3), said annular engagement zone (474*a*) being defined by a circle flattened in diametrically opposite areas (474*b*).

52. A lock assembly as set forth in claim 48, said hub member (474) being rotatable through an angle of substantially 90°, said drive unit releasing angular position and said drive unit locking angular position being defined by respective abutment means of said hub member (474) and said housing (403).

53. A lock assembly as set forth in claim 48, said handle bush and follower (412) being blocked against rotation in said second direction by said drive unit (410*a,b*) through said transmission linkage (16,24), when the hub member (474) is in its drive unit locking angular position.

54. A lock assembly as set forth in claim 16 or claim 48, said drive unit (410*a,b*) cooperating with a closing sensor unit (431) responsive to opening and closing said door or window, said closing sensor unit (431) permitting movement of said drive unit (410*a,b*) from said opening position to said locking position, only when the respective window or door is closed.

55. A lock assembly as set forth in claim 54, wherein said closing sensor unit (431) comprises a closing sensor member (431*a*) engageable with a door or window part (421) opposite to said face plate (401), said sensor member (431*a*) being biased towards a blocking position and being movable towards a releasing position thereof by engagement of said opposite part (421).

56. A lock assembly as set forth in claim 55, said sensor member (431) being guided transverse to said face plate (401) in a guiding block (415), said guiding block (415) having a guiding function also for said drive unit (410*a,b*).

57. A lock assembly as set forth in claim 48, said handle bush and follower (412) being blocked against rotation in said first direction by said drive unit (410*a,b*) through said transmission linkage (16,42), when said drive unit (410*a,b*) is in said opening position.

58. A lock assembly as set forth in claim 16 or claim 48, said drive unit (410*a,b*) acting on a bolt (454) mounted within said housing (403), said bolt (454) being engageable through an aperture of said face plate (401) with a part (421) of said door or window opposite to said face plate (401).

59. A lock assembly as set forth in claim 58, said bolt being a pivoting bolt (454) pivotably mounted within said housing (403).

60. A lock assembly as set forth in claim 59, said pivoting bolt (454) being drivable by said drive unit (410*a,b*) through a combination of a rack (410*b*1) allocated to said drive unit (410*a,b*) and a pinion (454*a*) allocated to said pivoting bolt (454).

61. A lock assembly as set forth in claim 60, said drive unit (410*a,b*) comprising a drive plate (410*a*) substantially parallel to a bottom wall of said housing (403) and a drive rod (410*b*) guided on said face plate (401), said rack (410*b*1) being a part of said drive rod (410*b*), said drive rod (410*b*) being connected for common linear movement with said drive plate (410*a*).

62. A lock assembly for doors or windows with a housing (203), a driver member (212) rotatable by a handle or knob (213) and mounted to rotate about an axis at right-angles to the door or window surface, restoring spring means which so pretensions the driver member (212) into a rest position that it can be rotated in opposite directions of rotation out of the rest position, at least one lock element (254) and transmission means connecting the driver member (212) with the lock element (254), said transmission means, comprising clearance defining means and serving, to displace the lock element (254), rotation of the driver member (212) in a first direction of rotation causing displacement of the lock element (254) into a locking position and rotation of the driver member (212) in a second direction of rotation causing displacement of the lock element (254) into an opening position, said clearance defining means in the transmission means of the lock element (254), after entry into the relevant lock element position and upon release of the handle or knob (213), allowing a return of the driver member (212), through the restoring spring means, into is rest position while leaving the lock element (254) in whichever lock element position has been reached, said lock assembly further comprising accommodating means for accommodating a locking unit (274), said locking unit comprising a hub member (274), which is rotatable between a lock element releasing angular position and a lock element locking angular position about an axis substantially perpendicular to the respective door or window surface, said hub member (274) being coupled for common rotation to both a hand-operated switch member (285) provided adjacent a first side face of said housing and a key-operated lock cylinder (283) provided adjacent a second side face of said housing, said key-operated lock cylinder (283) having a rotor member (283*b*) with a key (283*c*) receiving slot, the key (283*c*) being withdrawable from said slot only in a zero angular position of said rotor member (283*b*) with respect to said lock cylinder, said rotor member (283*b*) being coupled to said hub member (274) by coupling means (283*d*, 281) permitting angular play between said rotor member (283*b*) and said hub member (274), said angular play corresponding at least to the angular distance between said lock element locking angular position and said lock element releasing angular position of said hub member (274).

63. A lock assembly as set forth in claim 62, wherein said lock cylinder (283) is provided with a coupling spike (283*d*) extending through a coupling recess (281) of said hub member (274), said hand-operated switch member (285) being fixable on an end portion (283) of said coupling spike (283*d*).

64. A lock assembly as set forth in claim 62, wherein said hub member (274) is angularly movable through an angle of about 90°.

65. A lock assembly as set forth in claim 62, wherein said hand-operated switch member (285) has a non-circular shape allowing the identification of the angular position of said hand-operated switch member (285).

66. A lock assembly as set forth in claim 62, wherein said hub member (274) is elastically arrestable in said lock element releasing angular position and in said lock element locking angular position.

67. A lock assembly for doors or windows with a housing (403), a driver member (412) rotatable by a handle or knob (413) and mounted to rotate about an axis at right-angles to the door or window surface, restoring spring means (438) which so pretensions the driver member (412) into a rest position that it can be rotated in opposite directions of rotation out of the rest position, a drive unit (410*a*, 410*b*) guided lengthwise of a face plate (401) on the housing (403) and serving to control at least one lock element (454), and transmission means, connecting the driver member (412) with the drive unit (410*a*, 410*b*), said transmission means comprising clearance defining means and, said transmission means serving to displace the drive unit (410*a*, 410*b*), rotation of the driver member (412) in a first direction of rotation causing displacement of the drive unit (410*a*, 410*b*) into a locking position and rotation of the driver member (412) in a second direction of rotation causing displacement of the drive unit (410*a*, 410*b*) into an opening position, said clearance defining means in the transmission means, after entry of the drive unit (410*a*, 410*b*) into the relevant drive unit position and upon release of the handle or knob (413), allowing a return of the driver member (412), through the restoring spring means (438), into its rest position while leaving the drive unit (410*a*, 410*b*) in whichever drive unit position has been reached, said drive unit (410*a, b*) having at least one control profile (410*a*3) extending substantially parallel to said face plate (401), said control profile (410*a*3) cooperating with a hub member (474) engaging said control profile (410*a*3), said hub member (475) being rotatably mounted in said housing (403) between a drive unit releasing angular position and a drive unit locking angular position, said control profile (410*a*3) and said hub member (474) being shaped such that at least one of the below-mentioned requirements is fulfilled:

a) only in said locking position of said drive unit (401*a, b*), said hub member (474) is rotatable between its drive unit releasing angular position and its drive unit locking angular position;

b) movement of said drive unit (410*a, b*) from its locking position towards its opening position is only possible, when said hub member (474) is in said drive unit releasing angular position and c) in positions of said drive unit (410*a, b*) remote from said locking position, a rotation of said hub member (474) from said drive unit releasing angular position towards said drive unit locking angular position is prevented.

68. A lock assembly as set forth in claim 67, wherein said control profile (410*a*3) is provided by an elongated hole (410*a*2) of said drive unit (410*a, b*), said hub member (474) penetrating the elongated hole (410*a*2).

69. A lock assembly as set forth in claim 68, wherein said elongated hole (410*a*2) provides control profiles (410*a*3) on mutually opposite edges thereof.

70. A lock assembly as set forth in claim 67, wherein said hub member (474) has an annular engagement zone (474*a*) engageable with said at least one control profile (410*a*3), said annular engagement zone (474*a*) being defined by a circle flattened in diametrically opposite areas (474*b*).

71. A lock assembly as set forth in claim 67, wherein said hub member (474) is rotatable through an angle of substantially 90°, said drive unit releasing angular position and said drive unit locking angular position being defined by respective abutment means of said hub member (474) and said housing (403).

72. A lock assembly as set forth in claim 67, wherein said driver member (412) is blocked against rotation in said second direction by said drive unit (410*a, b*) through said transmission means when the hub member (474) is in its drive unit locking angular position.

73. A lock assembly for doors or windows with a housing (403), a driver member (412) rotatable by a handle or knob (413) and mounted to rotate about an axis at right-angles to the door or window surface, restoring spring means (438) which so pretensions the driver member (412) into a rest position that it can be rotated in opposite directions of rotation out of the rest position, a drive unit (410*a*, 410*b*) guided lengthwise of a face plate (401) on the housing (403) and serving to control at least one lock element (454), and transmission means, connecting the driver member (412) with the drive unit (410*a*, 410*b*), said transmission means comprising clearance defining means and transmission means serving to displace the drive unit (410*a*, 410*b*), rotation of the driver member (412) in a first direction of rotation causing displacement of the drive unit (410*a*, 410*b*) into a locking position and rotation of the driver member (412) in a second direction of rotation causing displacement of the drive unit (410*a*, 410*b*) into an opening position, said clearance defining means in the transmission means, after entry of the driver unit (410*a*, 410*b*) into the relevant drive unit position and upon release of the handle or knob (413), allowing a return of the driver member (412) through the restoring spring means (438) into its rest position while leaving the drive unit (410*a*, 410*b*) in whichever drive unit position has been reached, said drive unit (410*a, b*) cooperating with a closing sensor unit (431) responsive to opening and closing of said door or window, said closing sensor unit (431) permitting movement of said drive unit (410*a, b*) from said opening position to said locking position, only when the respective window or door is closed.

74. A lock assembly as set forth in claim 73, wherein said closing sensor unit (431) comprises a closing sensor member (431*a*) engageable with a door or window part (421) opposite to said face plate (401), said sensor member (431*a*) being biased towards a blocking position and being movable towards a releasing position thereof by engagement of said opposite part (421).

75. A lock assembly as set forth in claim 67, wherein said driver member (412) is blocked against rotation in said first direction by said drive unit (410*a, b*) through said transmission means when said drive unit (410*a, b*) is in said opening position.

76. A lock assembly as set forth in claim 73, wherein said driver member (412) is blocked against rotation in said first direction by said drive unit (410*a, b*) through said transmission means when said drive unit (410*a, b*) is in said opening position.

77. A drive rod lock for doors or windows with a housing (3), a driver member (12) rotatable by a handle or knob (13) and mounted to rotate about an axis at right-angles to the door or window surface, restoring spring means (38) which so pretensions the driver member (12) into a rest position that it can be rotated in opposite directions of rotation out of the rest position, a drive unit (10) guided lengthwise of a face plate (1) on the housing (3) and serving to control at least one lock element (54), and a transmission linkage (16, 42) comprising clearance defining means and connecting the driver member (12) to the drive unit (10), said transmission linkage (16, 42) comprising a transmission lever (42) serving, and to displace the drive unit (10), rotation of the driver member (12) in a first direction of rotation causing displacement of the drive unit (10) into a locking position and rotation of the driver member (12) in a second direction of rotation causing displacement of the drive unit (10) into an opening position, said clearance defining means (40′, 40″, 46) in the transmission linkage (16, 42), after entry of the drive unit (10) into the relevant drive unit position and upon release of the handle or knob (13), allowing a return of the driver member (12) through the restoring spring means (38) into its rest position while leaving the drive unit (10) in whichever drive unit position has been reached, said transmission linkage (16, 42) comprising a control element (16) guided in the vicinity of a limiting edge (3*c*) of the housing (3) disposed opposite the face plate (1) parallel with the drive unit (10), said control element (16) being coupled to the driver member (12), said restoring spring means (38) engaging said control element (16), said transmission lever (42) being constructed as a two-armed transmission lever (42) which is rockably mounted at a location between the drive unit (10) and the control element (16) on the housing, a first shorter lever arm (46) being, with clearance, in engagement with the control element (16), a longer lever arm (48) engaging the drive unit (10).

* * * * *